US010674804B1

(12) United States Patent
Hilliard et al.

(10) Patent No.: US 10,674,804 B1
(45) **Date of Patent: *Jun. 9, 2020**

(54) LOAD CARRIER SYSTEMS AND ASSOCIATED MANUFACTURING METHODS

(71) Applicant: Blue Force Gear, Inc., Pooler, GA (US)

(72) Inventors: Stephen G. Hilliard, Charleston, SC (US); Ashley A. Burnsed, Jr., Port Wentworth, GA (US)

(73) Assignee: BLUE FORCE GEAR, INC., Pooler, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/190,547

(22) Filed: Nov. 14, 2018

Related U.S. Application Data

(63) Continuation of application No. 16/034,293, filed on Jul. 12, 2018, now Pat. No. 10,159,328, which is a (Continued)

(51) Int. Cl.

| | |
|---|---|
| ***A45F 5/00*** | (2006.01) |
| ***A45F 5/02*** | (2006.01) |
| ***F42B 39/02*** | (2006.01) |
| ***F41C 33/02*** | (2006.01) |
| ***A41D 13/00*** | (2006.01) |
| *A45F 3/14* | (2006.01) |

(52) U.S. Cl.
CPC ..... *A45F 5/00* (2013.01); *A41D 13/0012* (2013.01); *A45F 5/02* (2013.01); *F41C 33/0218* (2013.01); *F42B 39/02* (2013.01); *A45F 3/14* (2013.01); *Y10T 24/13* (2015.01); *Y10T 29/49826* (2015.01)

(58) Field of Classification Search
CPC ..... A45F 5/00; A45F 5/02; Y10T 24/13
USPC ..... 224/675, 674, 930
See application file for complete search history.

(56) References Cited

U.S. PATENT DOCUMENTS 2,919,946 A 1/1960 Miener
3,460,207 A 8/1969 Stewart
(Continued)

FOREIGN PATENT DOCUMENTS

WO WO 2009052769 4/2009

OTHER PUBLICATIONS

Pals Connection Styles <http://milspecmonkey.com/customize/info/71-pals-connection-styles>, Jul. 8, 2009, 3 pages.

*Primary Examiner* — Justin M Larson
(74) *Attorney, Agent, or Firm* — Bennet K. Langlotz; Langlotz Patent & Trademark Works, LLC

(57) ABSTRACT

Embodiments of the invention relate to load carrier systems and associated manufacturing methods. In one embodiment, a load carrier system can include a unitary piece of material. The unitary piece of material can include a body portion comprising a first face side, an opposing face side, a first peripheral edge and an opposing second peripheral edge; and one or more straps comprising a respective extended end, wherein the straps are an integral part of the body portion; wherein the one or more straps are folded over onto the first face side adjacent to the first peripheral edge; and wherein at least one respective end of the one or more straps is fastened to the opposing second peripheral edge.

14 Claims, 27 Drawing Sheets

Related U.S. Application Data continuation-in-part of application No. 15/655,032, filed on Jul. 20, 2017, now Pat. No. 10,034,536, which is a continuation of application No. 15/079,663, filed on Mar. 24, 2016, now Pat. No. 9,737,129, which is a continuation of application No. 14/247,167, filed on Apr. 7, 2014, now Pat. No. 9,295,319, which is a continuation of application No. 13/163,347, filed on Jun. 17, 2011, now Pat. No. 8,720,762.

(56) References Cited

U.S. PATENT DOCUMENTS

| | | | | |
|---|---|---|---|---|
| 4,796,790 | A | 1/1989 | Hamilton | |
| 4,836,428 | A | 6/1989 | Evans et al. | |
| 5,042,113 | A | 8/1991 | Severson et al. | |
| 5,352,855 | A | 10/1994 | Potter | |
| 5,630,536 | A | 5/1997 | Bugnaski | |
| 5,724,707 | A | 3/1998 | Kirk et al. | |
| 6,056,300 | A | 5/2000 | Carpenter et al. | |
| 6,152,343 | A | 11/2000 | Shin | |
| 6,158,642 | A | 12/2000 | Herbage | |
| 6,209,679 | B1 | 4/2001 | Seals et al. | |
| 6,224,070 | B1 | 5/2001 | Carpenter et al. | |
| 6,293,566 | B1 | 9/2001 | Carpenter et al. | |
| 6,412,794 | B1 | 7/2002 | Phillips et al. | |
| 6,488,290 | B2 | 12/2002 | Carpenter et al. | |
| 6,712,251 | B2 | 3/2004 | Godshaw et al. | |
| 6,823,566 | B2 | 11/2004 | Coffey | |
| 6,926,302 | B1 | 8/2005 | Carpenter et al. | |
| 7,080,430 | B2 | 7/2006 | Wemmer | |
| 7,131,534 | B2 | 11/2006 | Enes | |
| 7,200,871 | B1 * | 4/2007 | Carlson | A41D 13/0012 2/102 |
| 7,240,404 | B2 | 7/2007 | Flossner | |
| 7,251,867 | B2 | 8/2007 | Wemmer | |
| 7,690,542 | B1 | 4/2010 | Silvera | |
| 7,694,862 | B2 | 4/2010 | Bergeron | |
| 7,963,427 | B2 | 6/2011 | Calkin | |
| 8,002,159 | B2 | 8/2011 | Cragg | |
| 8,453,899 | B1 * | 6/2013 | Calkin | A45F 5/02 224/675 |
| 8,720,762 | B2 * | 5/2014 | Hilliard | F42B 39/02 224/675 |
| 9,295,319 | B1 * | 3/2016 | Hilliard | F42B 39/02 |
| D767,824 | S * | 9/2016 | Hilliard | D29/100 |
| 9,486,058 | B1 * | 11/2016 | Moreau | A45F 3/00 |
| 9,521,897 | B2 * | 12/2016 | Thompson | A45F 5/02 |
| 9,565,922 | B2 * | 2/2017 | Cole | A45F 5/02 |
| 9,737,129 | B1 * | 8/2017 | Hilliard | F42B 39/02 |
| 10,034,536 | B1 * | 7/2018 | Hilliard | F42B 39/02 |
| 10,159,328 | B1 * | 12/2018 | Hilliard | A45F 5/00 |
| 2001/0035443 | A1 * | 11/2001 | Jones | A45C 1/04 224/222 |
| 2002/0113105 | A1 | 8/2002 | Jarman | |
| 2007/0221693 | A1 | 9/2007 | Moore | |
| 2008/0086846 | A1 | 4/2008 | Wemmer | |
| 2008/0190974 | A1 * | 8/2008 | Finn | A45F 5/00 224/267 |
| 2010/0301086 | A1 | 12/2010 | Herron et al. | |
| 2010/0308086 | A1 | 12/2010 | Chapuis | |
| 2012/0318834 | A1 * | 12/2012 | Hilliard | F42B 39/02 224/250 |
| 2012/0318835 | A1 * | 12/2012 | Hilliard | F42B 39/02 224/255 |
| 2016/0135575 | A1 * | 5/2016 | Solomon | A45F 5/00 224/235 |

* cited by examiner

LOAD CARRIER SYSTEMS AND ASSOCIATED MANUFACTURING METHODS

REFERENCE TO RELATED APPLICATION

This is a Continuation of U.S. patent application Ser. No. 16/034,293, filed Jul. 12, 2018, entitled "LOAD CARRIER SYSTEMS AND ASSOCIATED MANUFACTURING METHODS," which is Continuation-in-Part of U.S. patent application Ser. No. 15/655,032, filed Jul. 20, 2017, now issued as U.S. Pat. No. 10,034,536, entitled "LOAD CARRIER SYSTEMS AND ASSOCIATED MANUFACTURING METHODS," which is a Continuation of U.S. patent application Ser. No. 15/079,663, filed Mar. 24, 2016, now issued as U.S. Pat. No. 9,737,129, entitled "LOAD CARRIER SYSTEMS AND ASSOCIATED MANUFACTURING METHODS," which is a Continuation of U.S. patent application Ser. No. 14/247,167, filed Apr. 7, 2014, now issued as U.S. Pat. No. 9,295,319, entitled "LOAD CARRIER SYSTEMS AND ASSOCIATED MANUFACTURING METHODS," which is a Continuation of U.S. patent application Ser. No. 13/163,347, filed Jun. 17, 2011, now issued as U.S. Pat. No. 8,720,762, entitled "LOAD CARRIER SYSTEMS AND ASSOCIATED MANUFACTURING METHODS."

TECHNICAL FIELD

The invention relates generally to load carriers, and more particularly to load carrier systems and associated manufacturing methods.

BACKGROUND OF THE INVENTION

Conventional load carrying devices, such as load carriers, can be used for a variety of equipment and objects, including firearms, weapons, ammunition, munitions, safety items, life support products, emergency-type items, and common household goods. In certain instances, conventional load carriers can be used by military personnel to carry ammunition or other relatively small objects. Some conventional load carrying devices utilize a series of connectors, such as straps, buttons, or hook and loop (Velcro™) connectors. An example conventional series of connectors, shown as a strap system, is shown as 100 in FIG. 1.

As shown in FIG. 1, a conventional strap system for a load carrying device can include a series of straps 102 sewn to a garment, such as a shirt 104. The straps 102 can function as an interface when other straps 106 connected to another device, such as a separable pocket 108, are interleaved through one or more of the series of straps 102 of the garment or shirt 104. A snap fastener, such as 110, can secure the separable pocket 108 to the garment 104. The connection or interface created by the convention strap system can be quickly facilitated as well as quickly undone. In certain instances, the connection or interface can be used between other objects, such as field packs, luggage, bags, clothing, and other weapon and munitions carriers.

Typically, conventional load carrying devices and strap systems are made from many different components, which must be suitably made, inspected, assembled, and inspected again before use in the field. When individual components are incorrectly made, or when faulty components are assembled into a final assembled product, manufacturing and quality control costs may increase, adding to the ultimate price to an end user.

Conventional load carrying devices and strap systems generally have drawbacks in design that may increase the ultimate weight of the load carried by a user. Conventional load carrying devices and strap systems also generally have drawbacks in manufacturing that increase the cost and time of manufacturing.

SUMMARY OF THE INVENTION

Embodiments of the invention can provide some or all of the above needs. Certain embodiments of the invention can provide load carrier systems and associated manufacturing methods. In one embodiment, a load carrier system can include a unitary piece of material. The unitary piece of material can include a body portion comprising a first face side, an opposing face side, a first peripheral edge and an opposing second peripheral edge; and one or more straps comprising a respective extended end, wherein the straps are an integral part of the body portion; wherein the one or more straps are folded over adjacent to the first peripheral edge onto the first face side; and wherein at least one respective end of the one or more straps is fastened to the opposing second peripheral edge.

In one aspect of an embodiment, the unitary piece of material can further include at least one connector oriented substantially perpendicular to the one or more straps, the at least one connector comprising a respective extended end, wherein the at least one connector is an integral part of the body portion; wherein the at least one connector is folded over adjacent to a third peripheral edge of the body portion, the third peripheral edge positioned between the first peripheral edge and the opposing second peripheral edge; and wherein the at least one respective end of the at least one connector is fastened to a fourth edge opposite of the third peripheral edge.

In one aspect of an embodiment, the unitary piece of material can include at least one of the following: neoprene, high abrasion neoprene, chloroprene, high abrasion chloroprene, canvas, or a camouflaged material.

In one aspect of an embodiment, the unitary piece of material is die cut or laser cut from a relatively larger piece of material.

In one aspect of an embodiment, the system can further include a second unitary piece of material, wherein the second unitary piece of material is fastened to the opposing face side with an opening between the unitary piece of material and second unitary piece of material adjacent to at least one peripheral edge of the unitary piece of material.

In another embodiment, a method for manufacturing a load carrier system can be provided. The method can include providing a unitary piece of material and cutting the unitary piece of material in a unitary shape. The unitary shape can include a body portion comprising a first face side, an opposing face side, a first peripheral edge and an opposing second peripheral edge; and one or more straps comprising a respective extended end, wherein the straps are an integral part of the body portion. The method can further include folding the one or more straps over adjacent to the first peripheral edge onto the first face side; and fastening at least one respective end of the one or more straps to the opposing second peripheral edge.

In one aspect of an embodiment, the unitary shape can further include at least one connector oriented substantially perpendicular to the one or more straps, the at least one connector comprising a respective extended end, wherein the at least one connector is an integral part of the body portion, and the method can further include folding the at least one connector over adjacent to a third peripheral edge of the body portion, the third peripheral edge positioned between the first peripheral edge and the opposing second peripheral edge; and fastening the at least one respective end of the at least one connector to a fourth edge opposite of the third peripheral edge.

In one aspect of an embodiment, the unitary piece of material can include at least one of the following: neoprene, high abrasion neoprene, chloroprene, high abrasion chloroprene, canvas, or a camouflaged material.

In one aspect of an embodiment, cutting the unitary piece of material in a unitary shape can include die cutting the unitary piece of material from a relatively larger piece of material.

In one aspect of an embodiment, the method can further include providing a second unitary piece of material; and fastening the second unitary piece of material to the opposing face side with an opening between the unitary piece of material and second unitary piece of material adjacent to at least one peripheral edge of the unitary piece of material.

In one aspect of an embodiment, one or more elements of the method are implemented by a processor and a set of computer-executable instructions stored on a computer readable medium.

In yet another embodiment, a load carrier system can be provided. The system can include a unitary piece of material. The unitary piece of material can include a body portion with a first face side, an opposing face side, a first peripheral edge, and an opposing second peripheral edge. The unitary piece of material can also include one or more straps comprising a respective extended end, wherein the straps are an integral part of the body portion; and at least one connector oriented substantially perpendicular to the one or more straps, the at least one connector comprising a respective extended end, wherein the at least one connector is an integral part of the body portion; wherein the one or more straps are folded over adjacent to the first peripheral edge onto the first face side; wherein at least one respective end of the one or more straps is fastened to the opposing second peripheral edge; wherein the at least one connector is folded over adjacent to a third peripheral edge of the body portion, the third peripheral edge positioned between the first peripheral edge and the opposing second peripheral edge; and wherein the at least one respective end of the at least one connector is fastened to a fourth edge opposite of the third peripheral edge. The system can further include a second unitary piece of material, wherein the second unitary piece of material is fastened to the opposing face side with an opening between the unitary piece of material and second unitary piece of material adjacent to at least one peripheral edge of the unitary piece of material.

In one aspect of an embodiment, the unitary piece of material can include at least one of the following: neoprene, high abrasion neoprene, chloroprene, high abrasion chloroprene, canvas, or a camouflaged material.

In one aspect of an embodiment, the unitary piece of material is die cut or laser cut from a relatively larger piece of material.

Other systems, methods, apparatus, features, and aspects according to various embodiments of the invention will become apparent with respect to the remainder of this document.

BRIEF DESCRIPTION OF DRAWINGS

Figure 1:
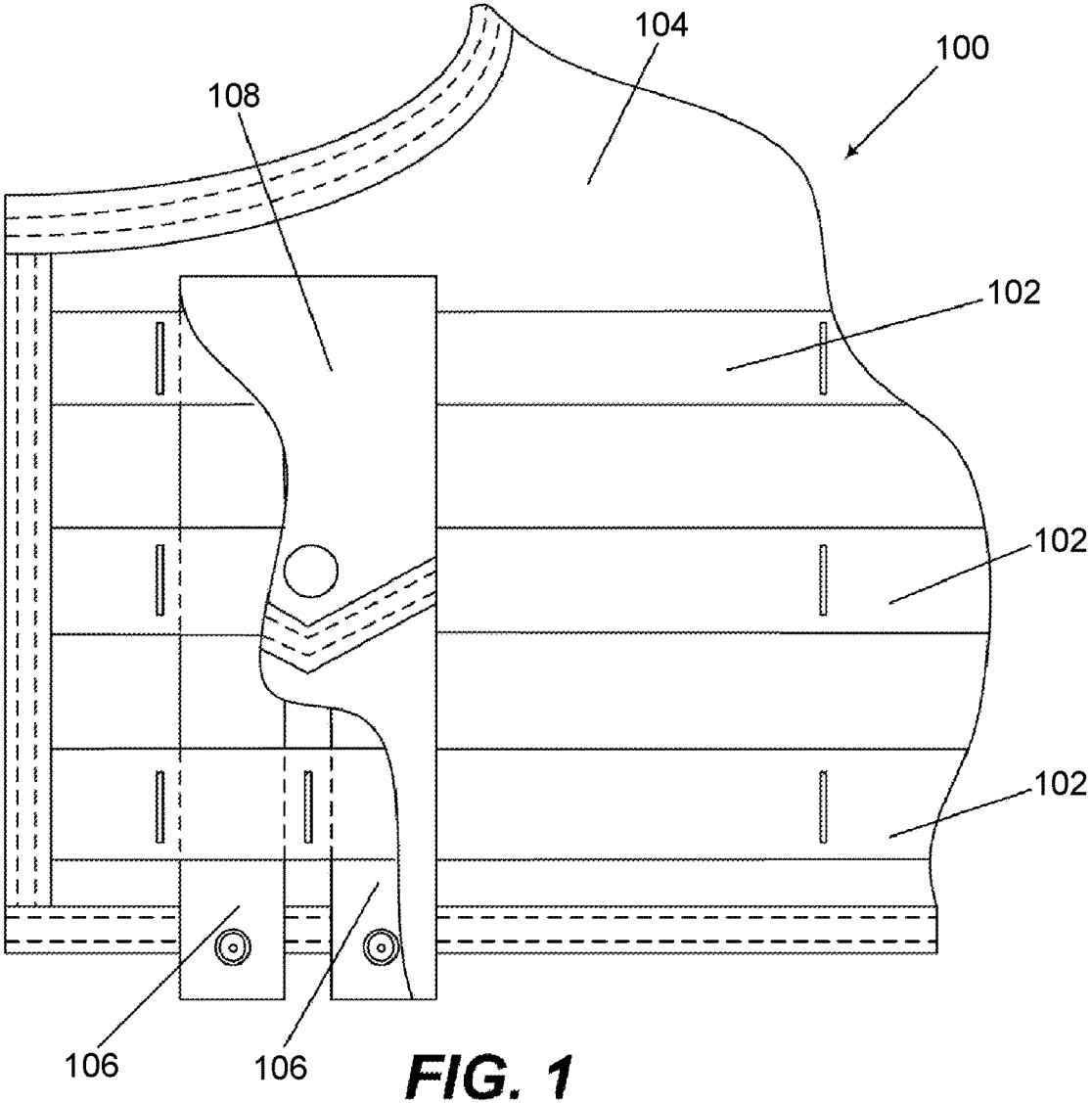
FIG. 1 (PRIOR ART)

Having thus described embodiments of the invention in general terms, reference will now be made to the accompanying drawings, which are not drawn to scale, and wherein:

FIG. 1 illustrates a conventional strap system for a load carrying device.

Figure 2:
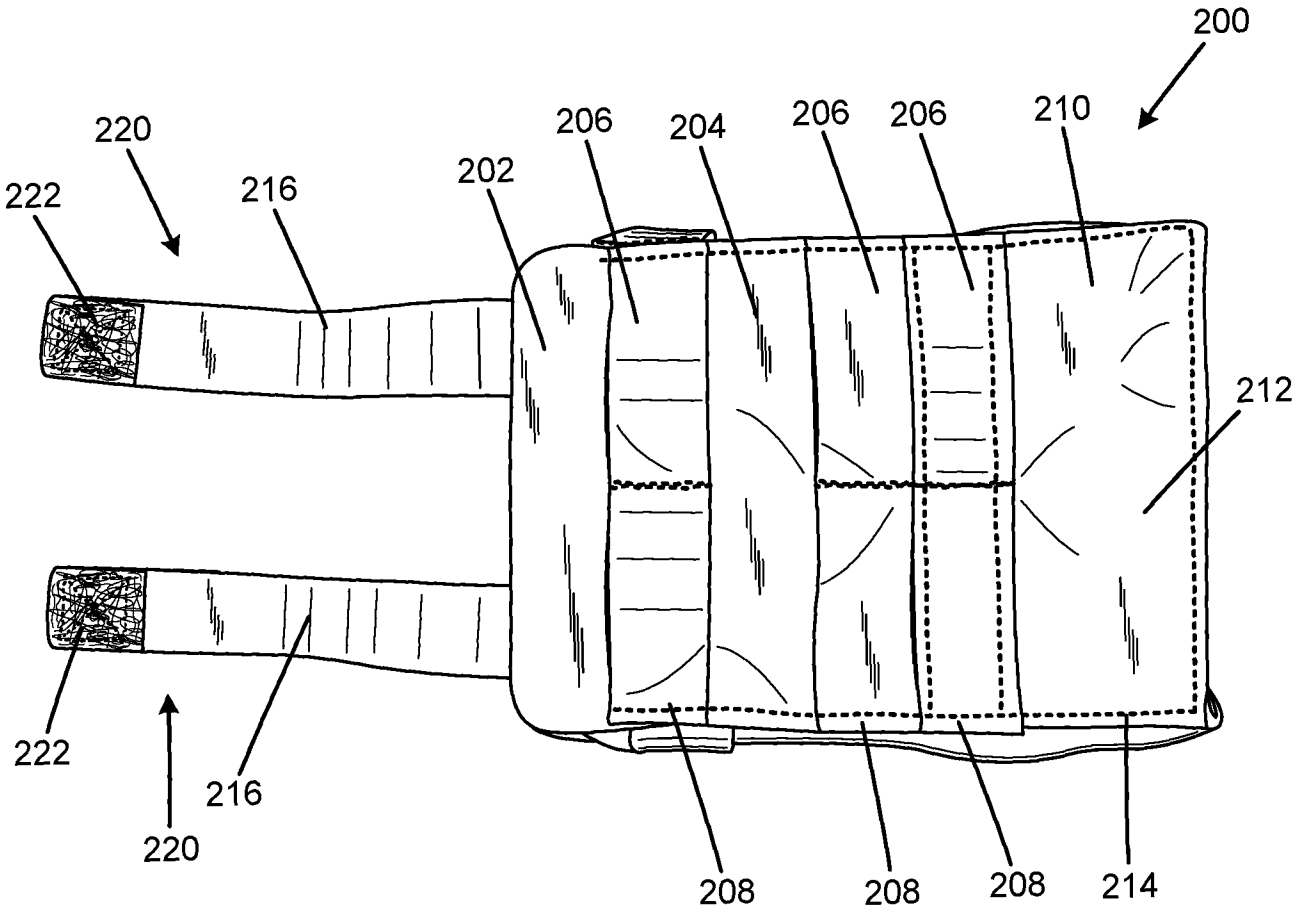

FIG. 2 illustrates an example unitary piece of material for an example load carrier system being cut from a relatively larger piece of material, in accordance with an embodiment of the invention.

Figure 3:
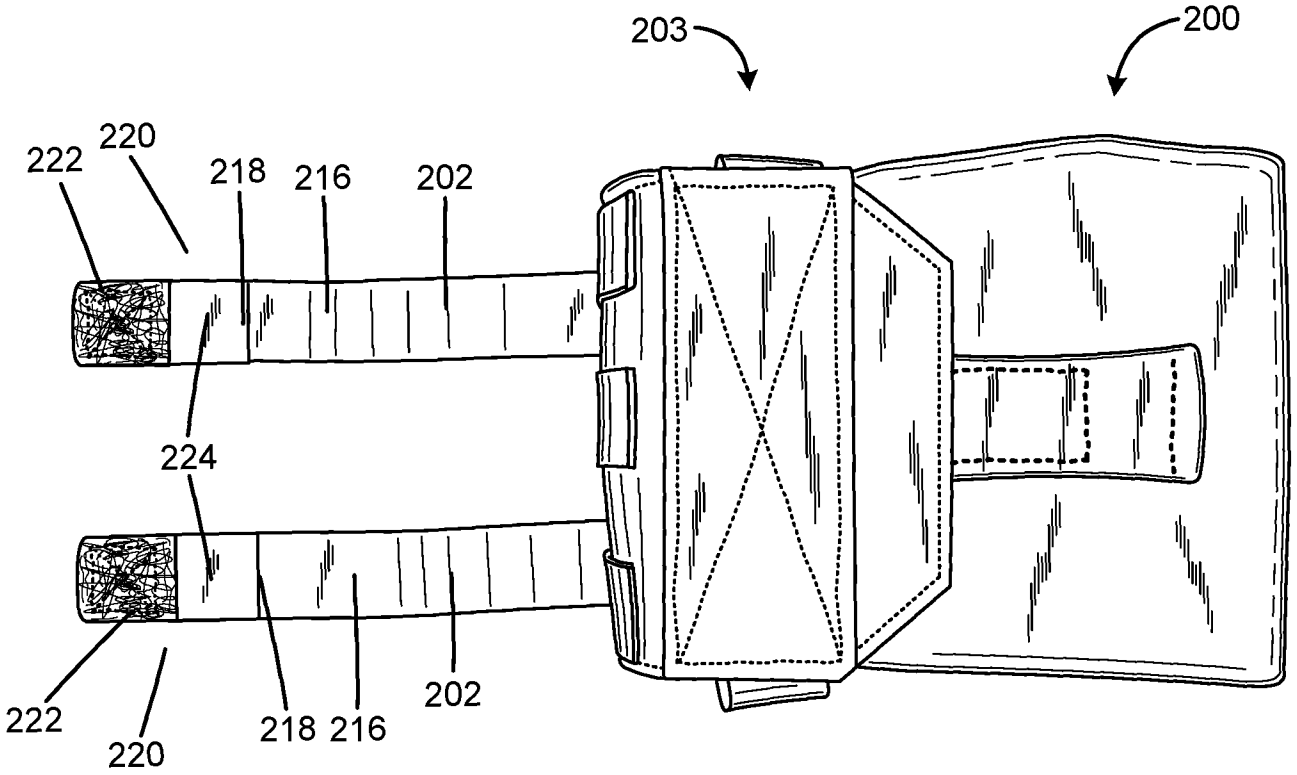

FIG. 3 illustrates the unitary piece of material of FIG. 2 cut away from the relatively larger piece of material, in accordance with an embodiment of the invention.

Figure 4:
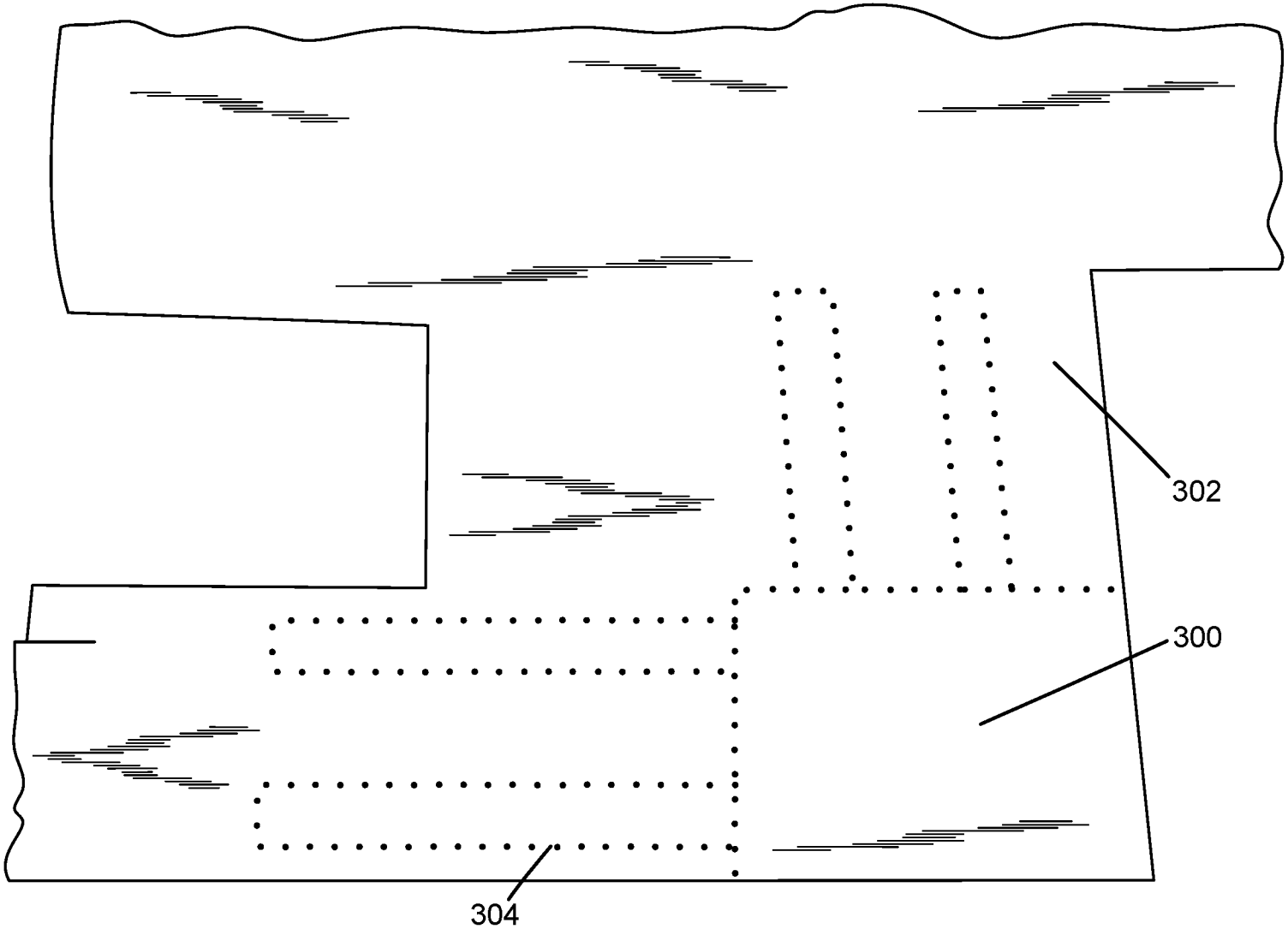

FIG. 4 illustrates an example marking operation performed on the unitary piece of material of FIGS. 2-3, in accordance with an embodiment of the invention.

Figure 5:
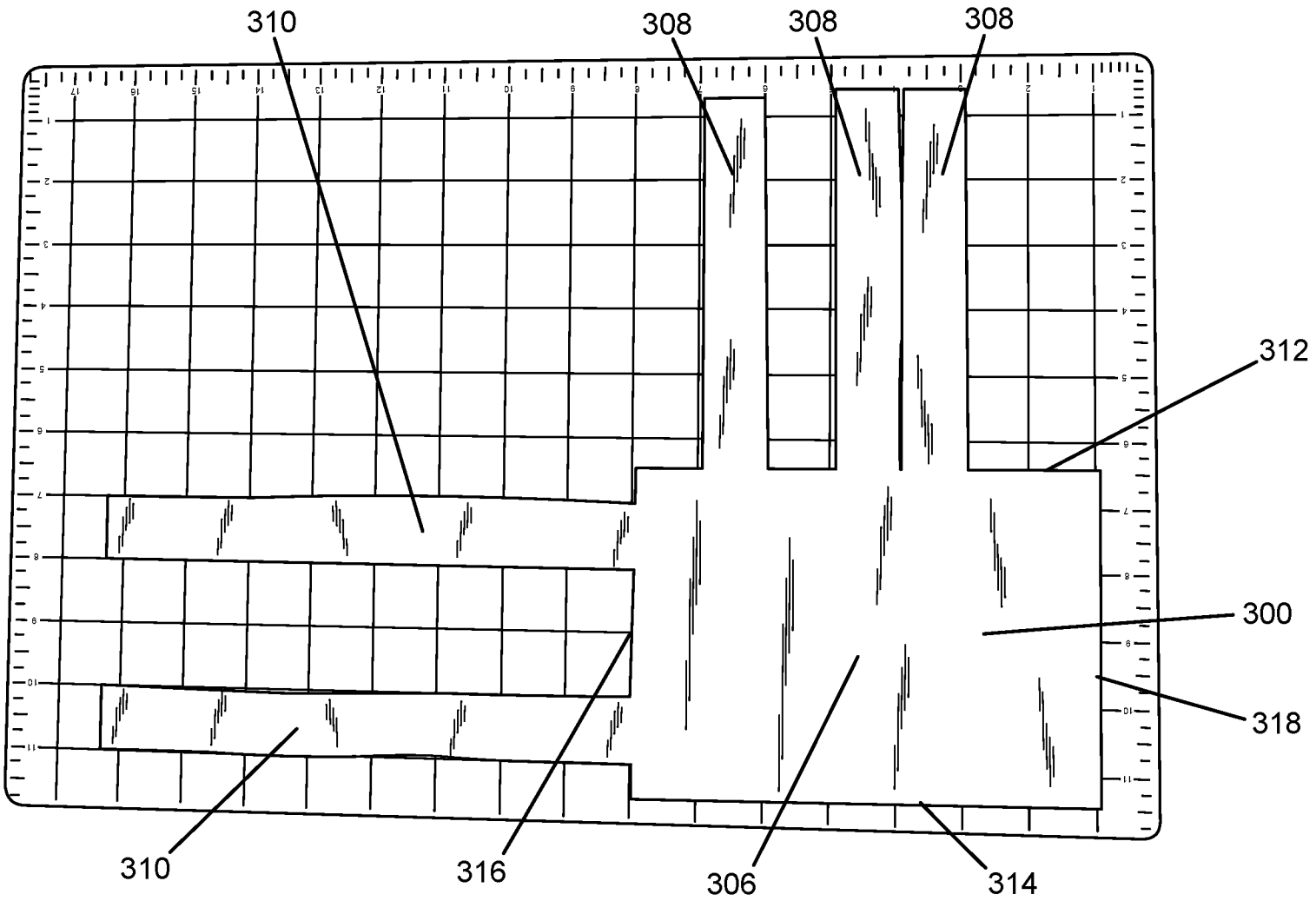

FIG. 5 illustrates an example assembly operation performed on the unitary piece of material of FIGS. 2-4, in accordance with an embodiment of the invention.

Figure 6:
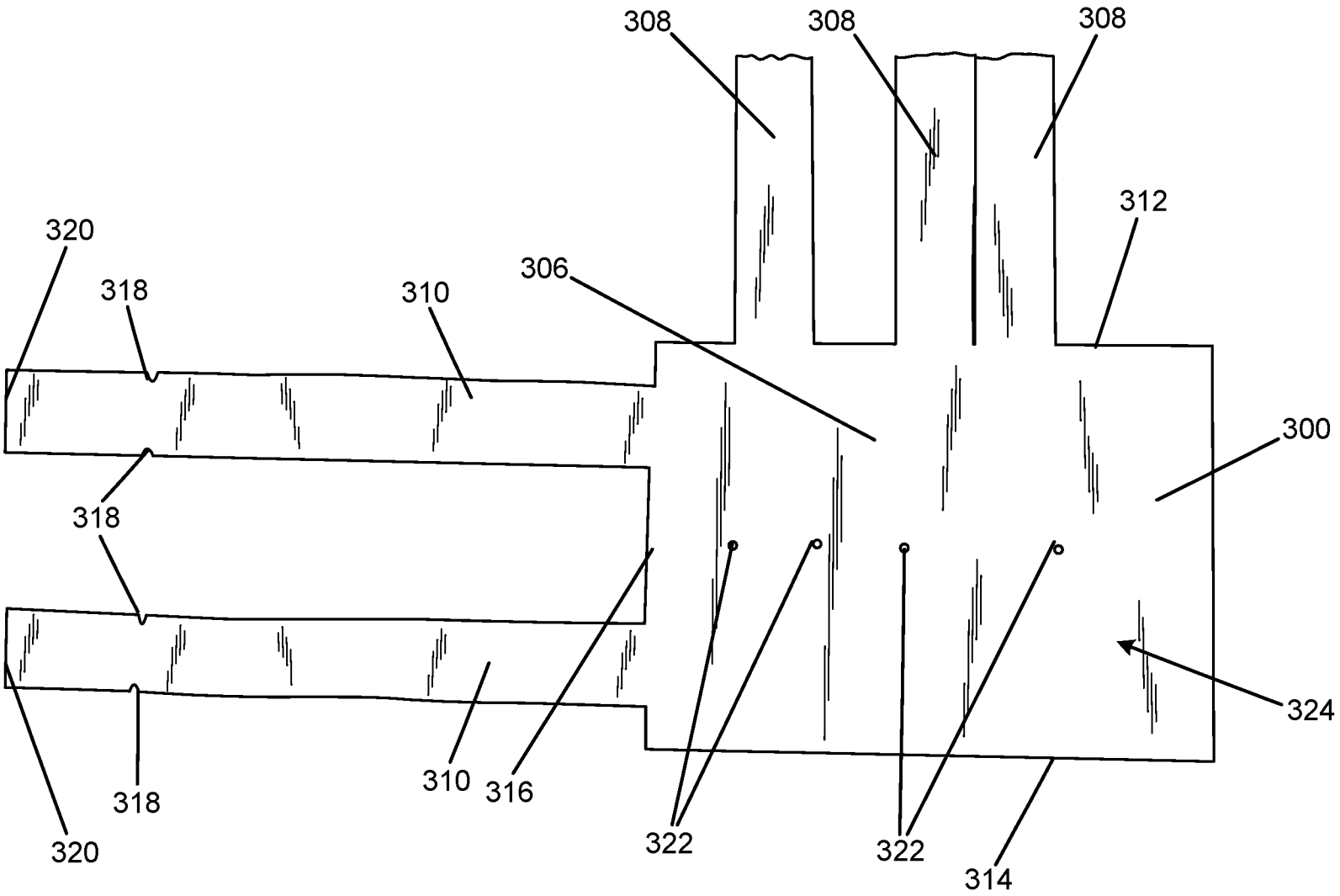

FIG. 6 illustrates another example assembly operation performed on the unitary piece of material of FIGS. 2-5, in accordance with an embodiment of the invention.

Figure 7:
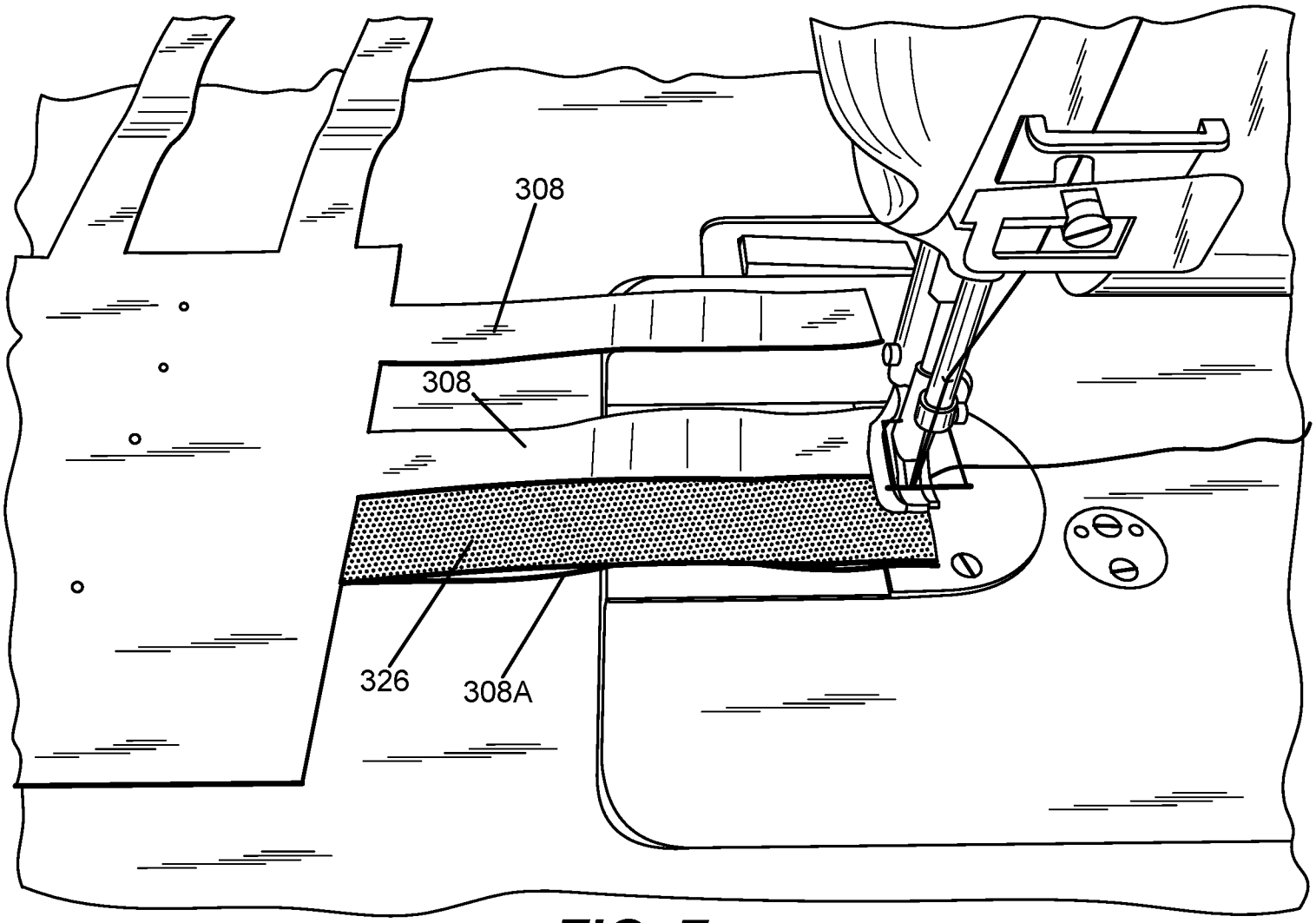

FIG. 7 illustrates an initial assembly stage for the unitary piece of material of FIGS. 2-6, in accordance with an embodiment of the invention.

Figure 8:
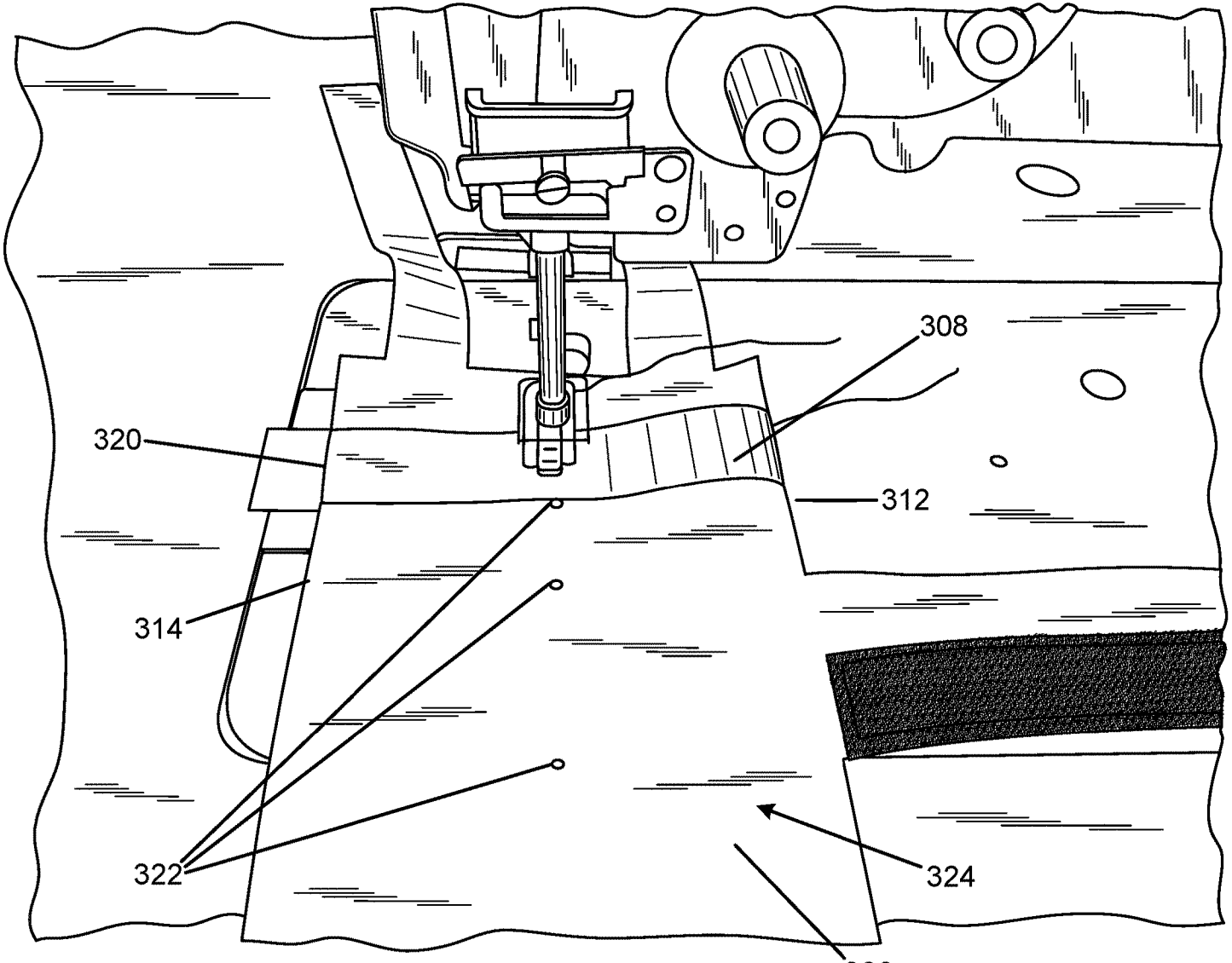

FIG. 8 illustrates an example folding operation performed on the unitary piece of material of FIGS. 2-7, in accordance with an embodiment of the invention.

Figure 9:
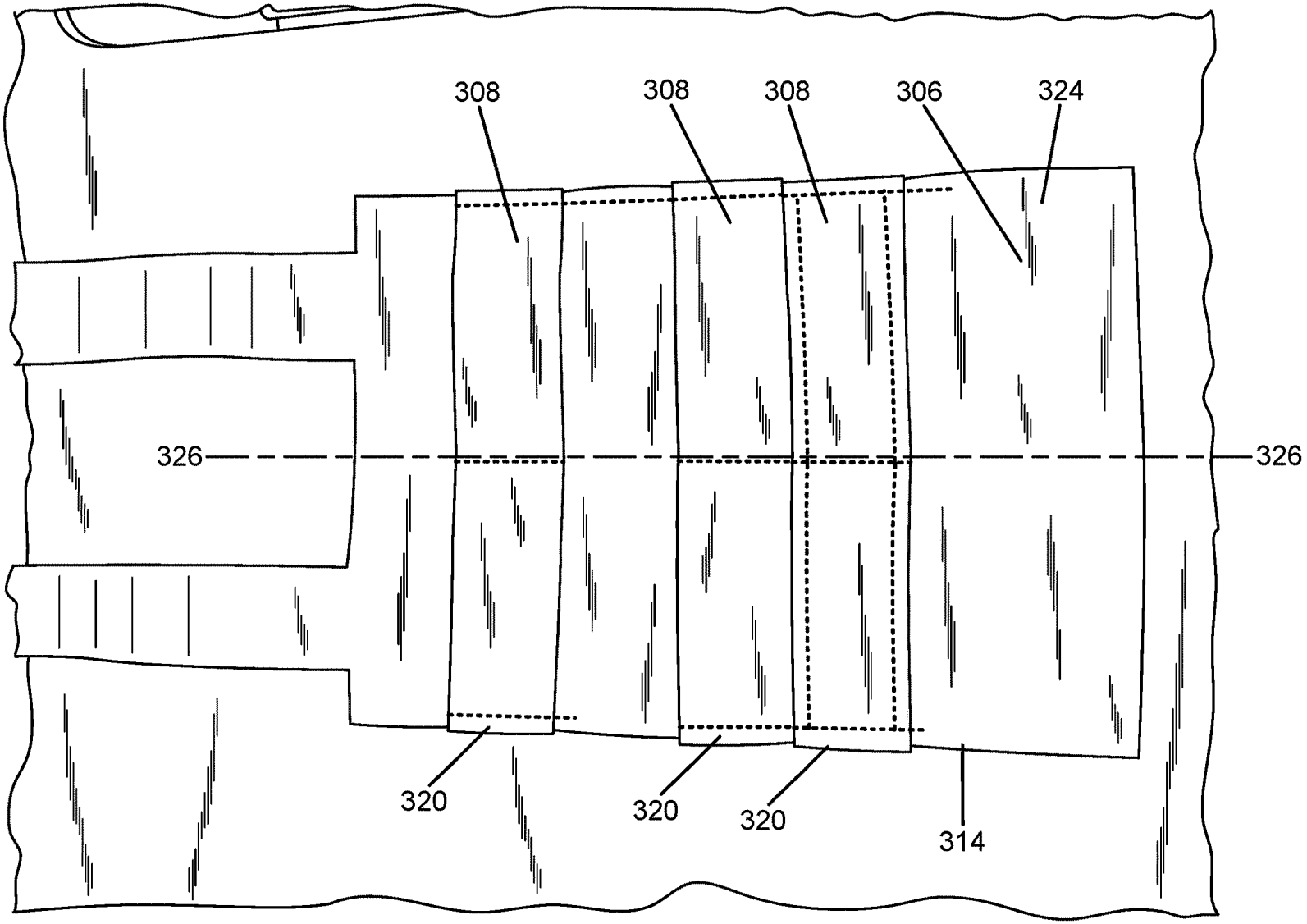

FIG. 9 illustrates another example assembly operation performed on the unitary piece of material of FIGS. 2-8, in accordance with an embodiment of the invention.

Figure 10:
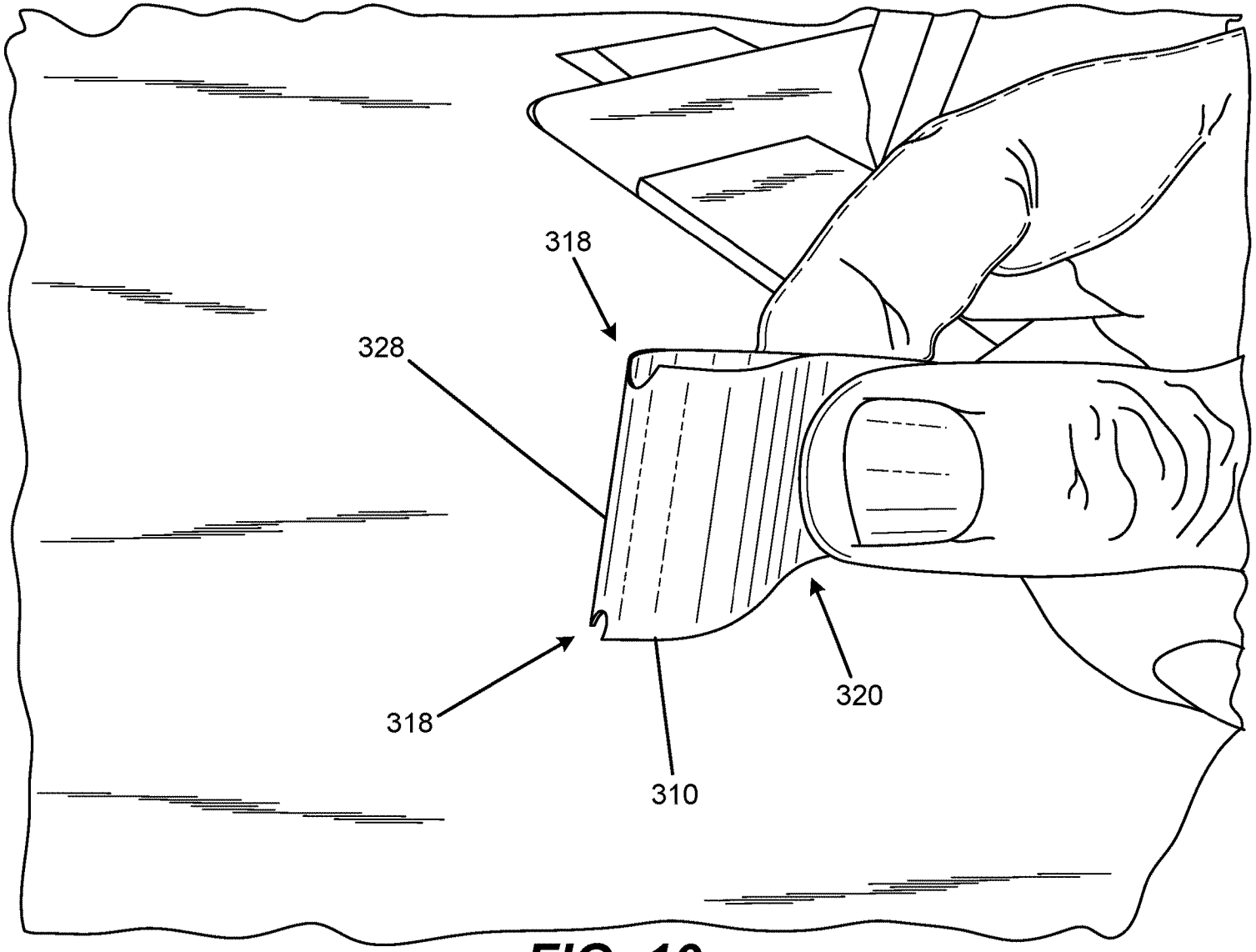

FIG. 10 illustrates an intermediate assembly stage for the unitary piece of material of FIGS. 2-9, in accordance with an embodiment of the invention.

Figure 11:
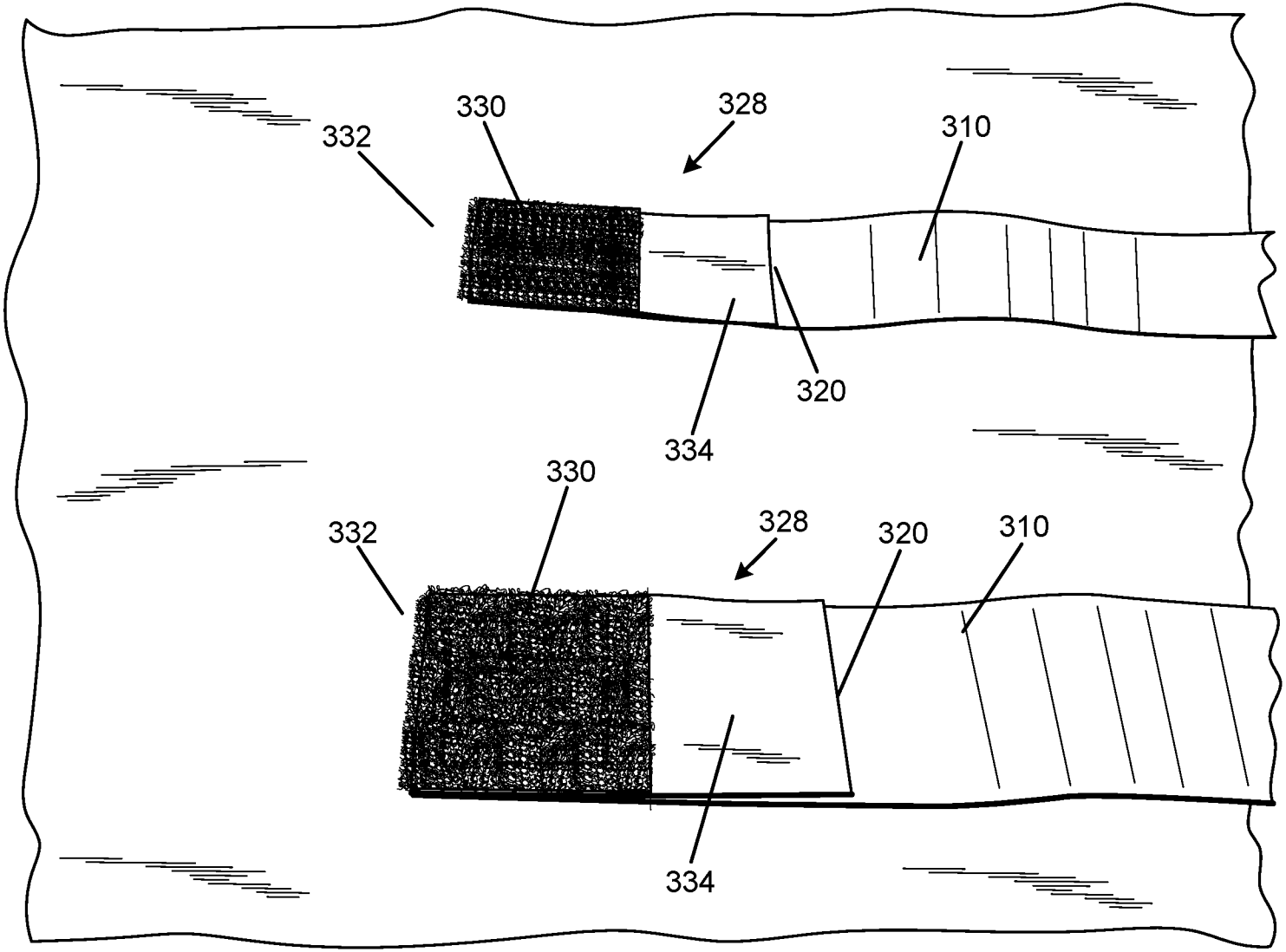

FIG. 11 illustrates a front view of an example load carrier system, after a load component is mounted to one face of the unitary piece of material shown in FIGS. 2-10, in accordance with an embodiment of the invention.

Figure 12:
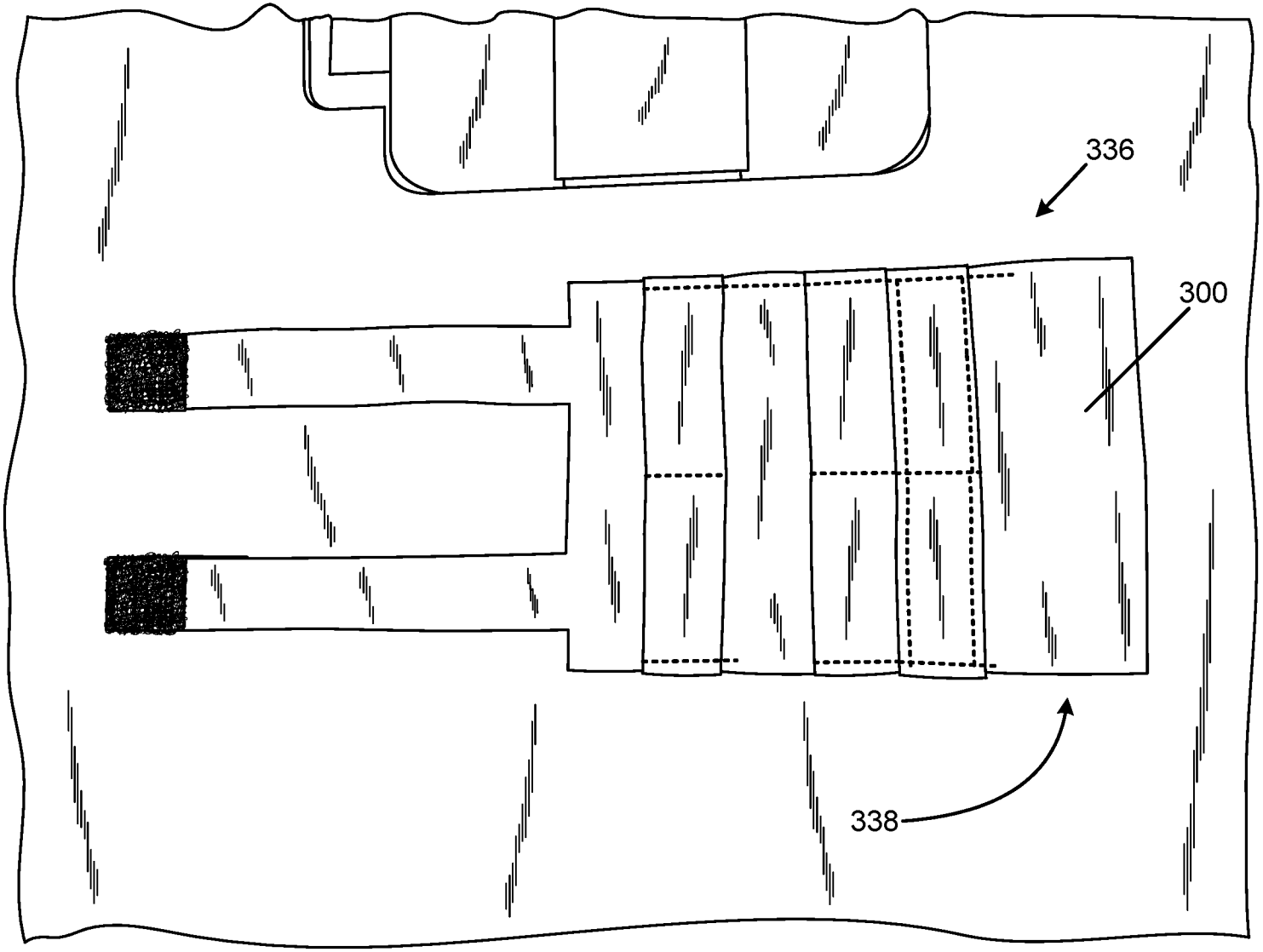

FIG. 12 illustrates a back view of an example load carrier system, after a load component is mounted to an opposing face of the unitary piece of material shown in FIGS. 2-11, in accordance with an embodiment of the invention.

Figure 13:
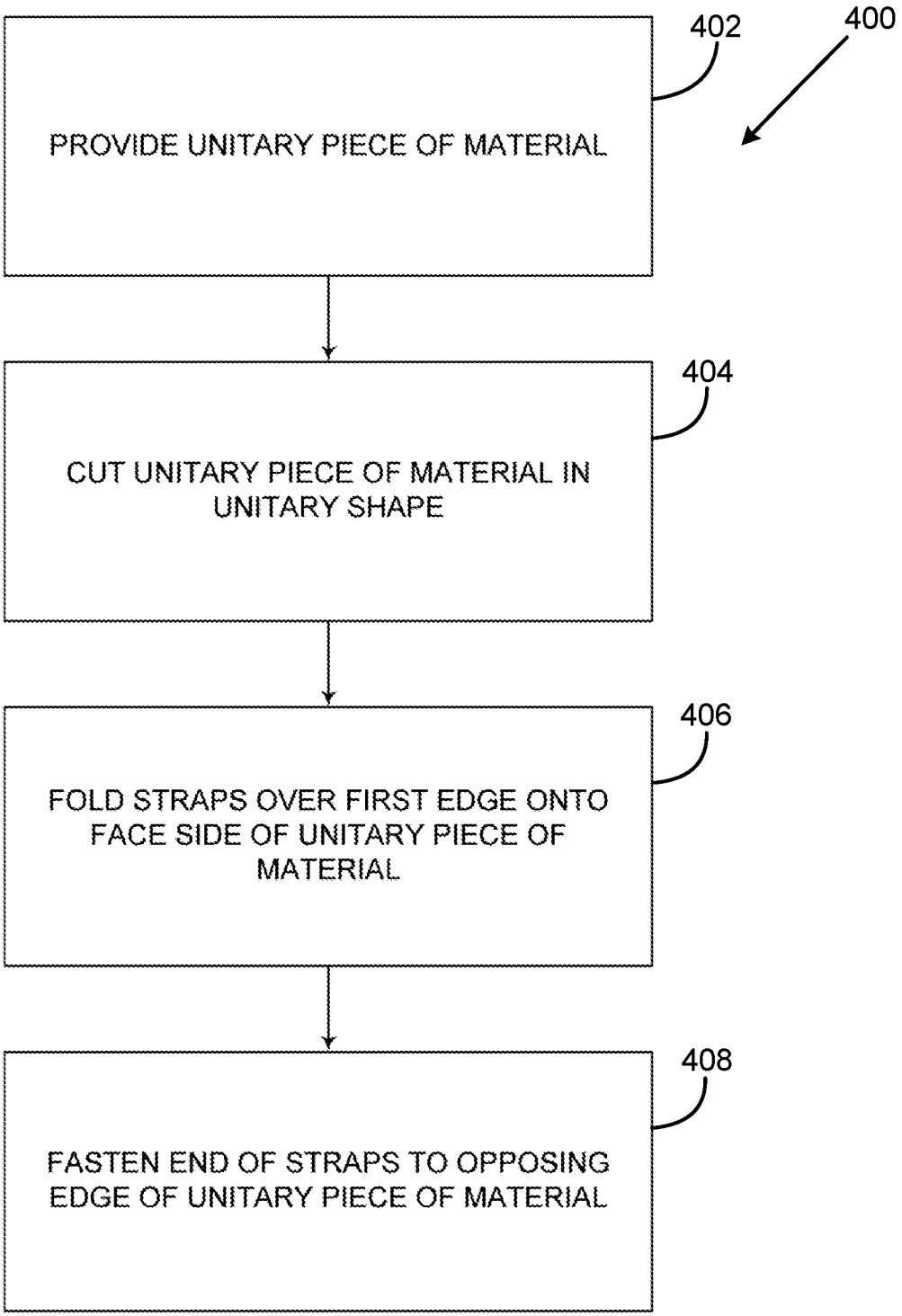

FIG. 13 illustrates an example manufacturing method in accordance with an embodiment of the invention.

FIGS. 14-21 and 23 illustrate an example connection configuration and method for an example load carrier system in accordance with embodiments of the invention.

Figure 22:
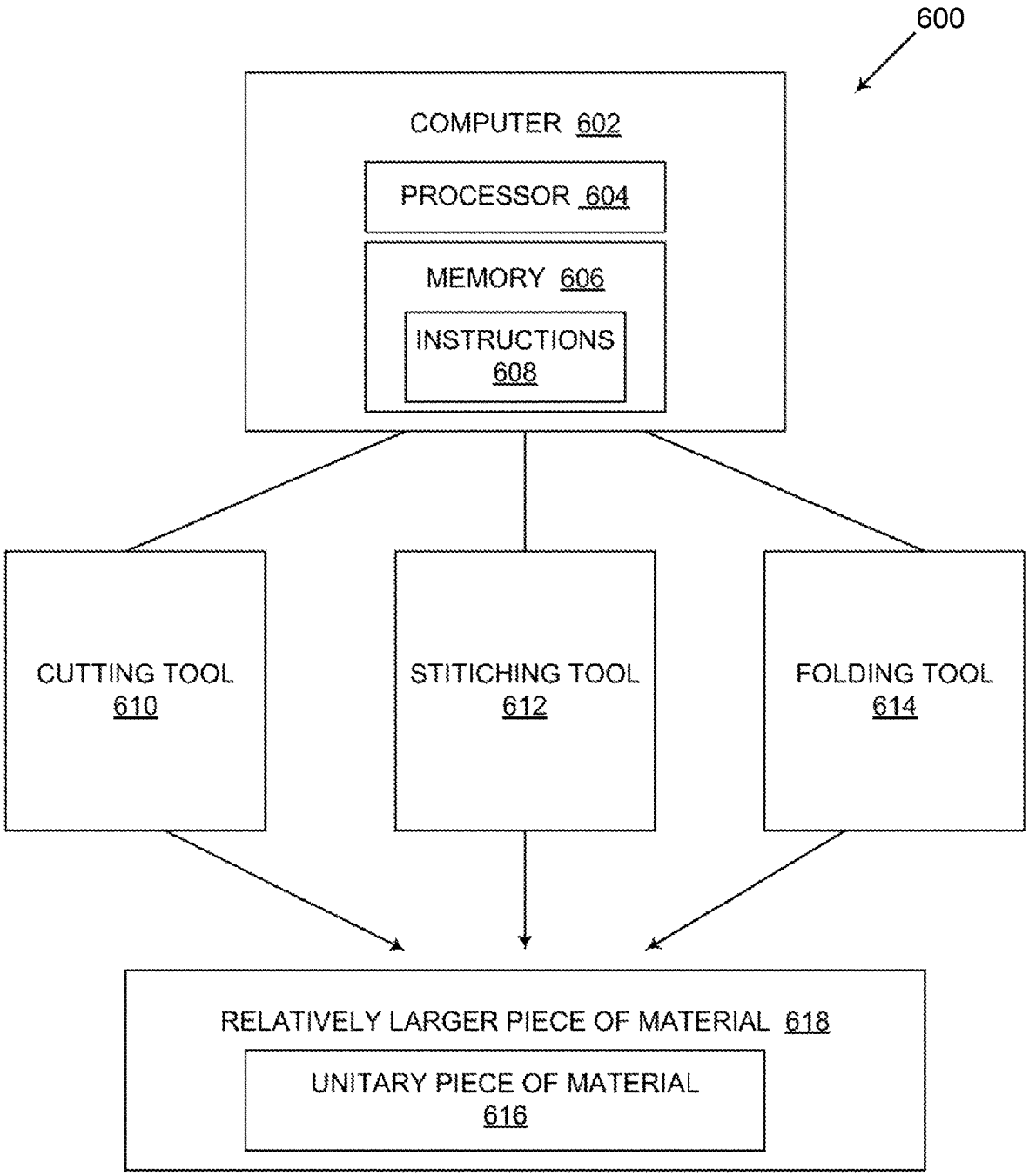
Figure 23:
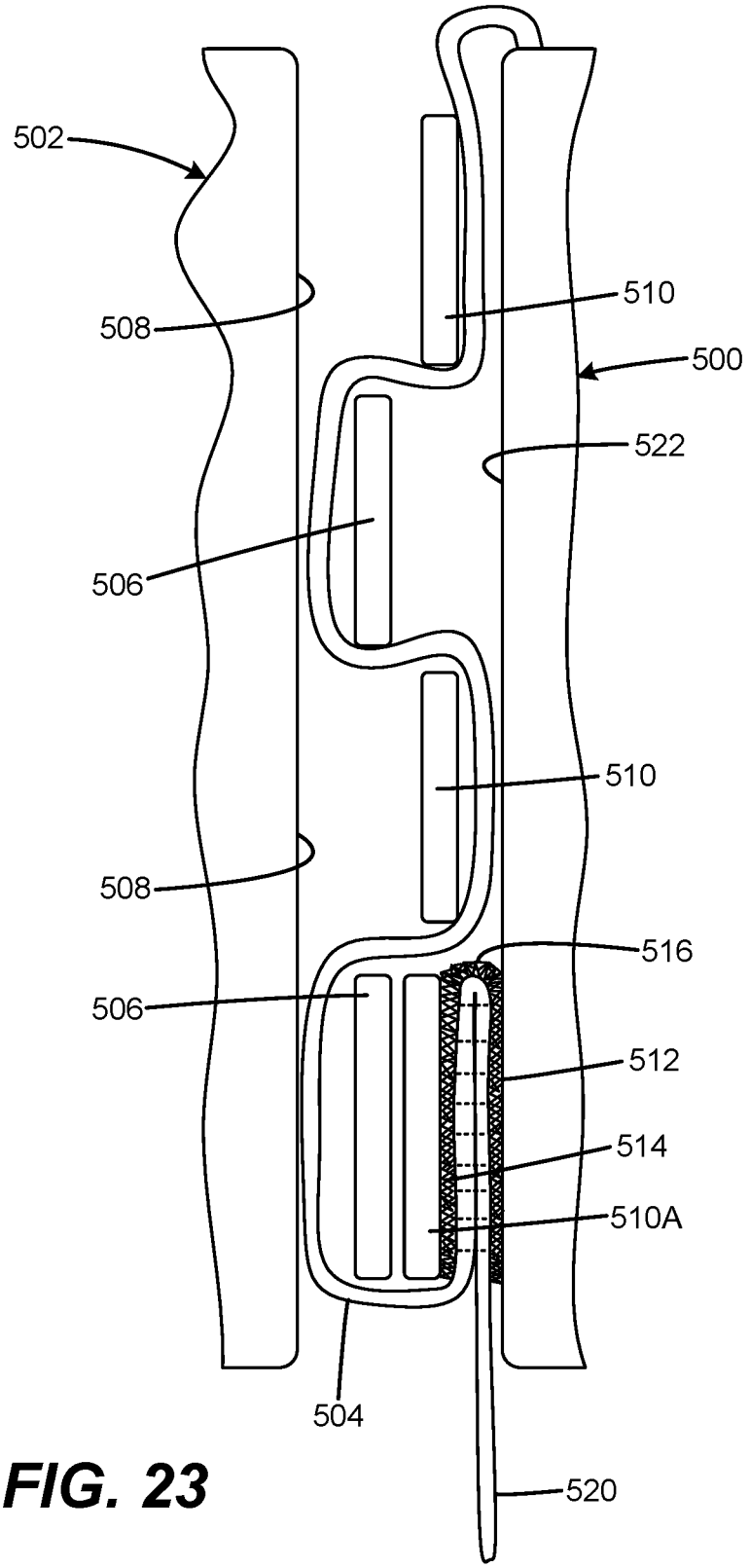

FIG. 22 illustrates an example manufacturing system in accordance with an embodiment of the invention.

Figure 24:
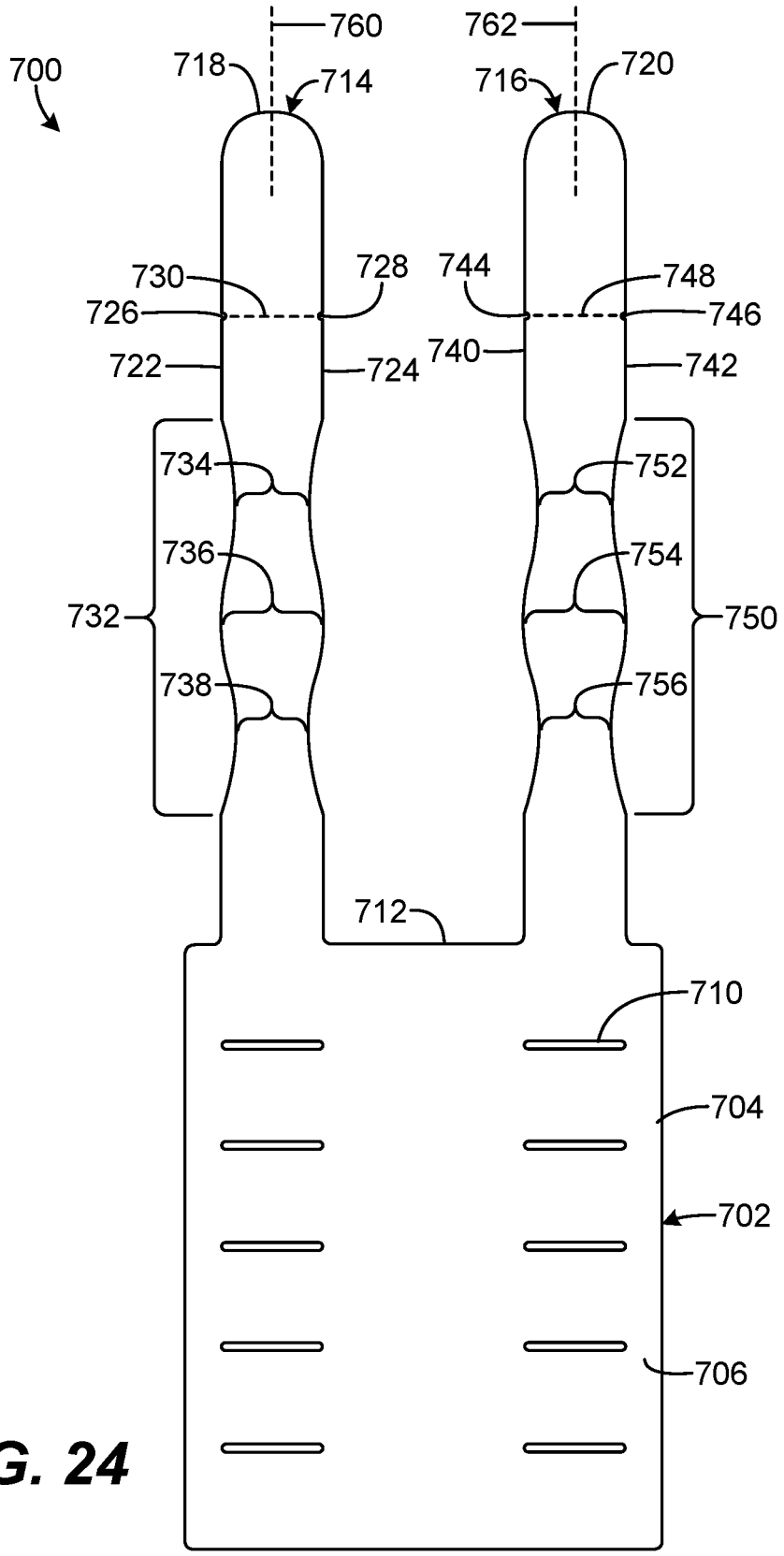

FIG. 24 illustrates a rear view of a first alternative embodiment of the load carrier system of the invention.

Figure 25:
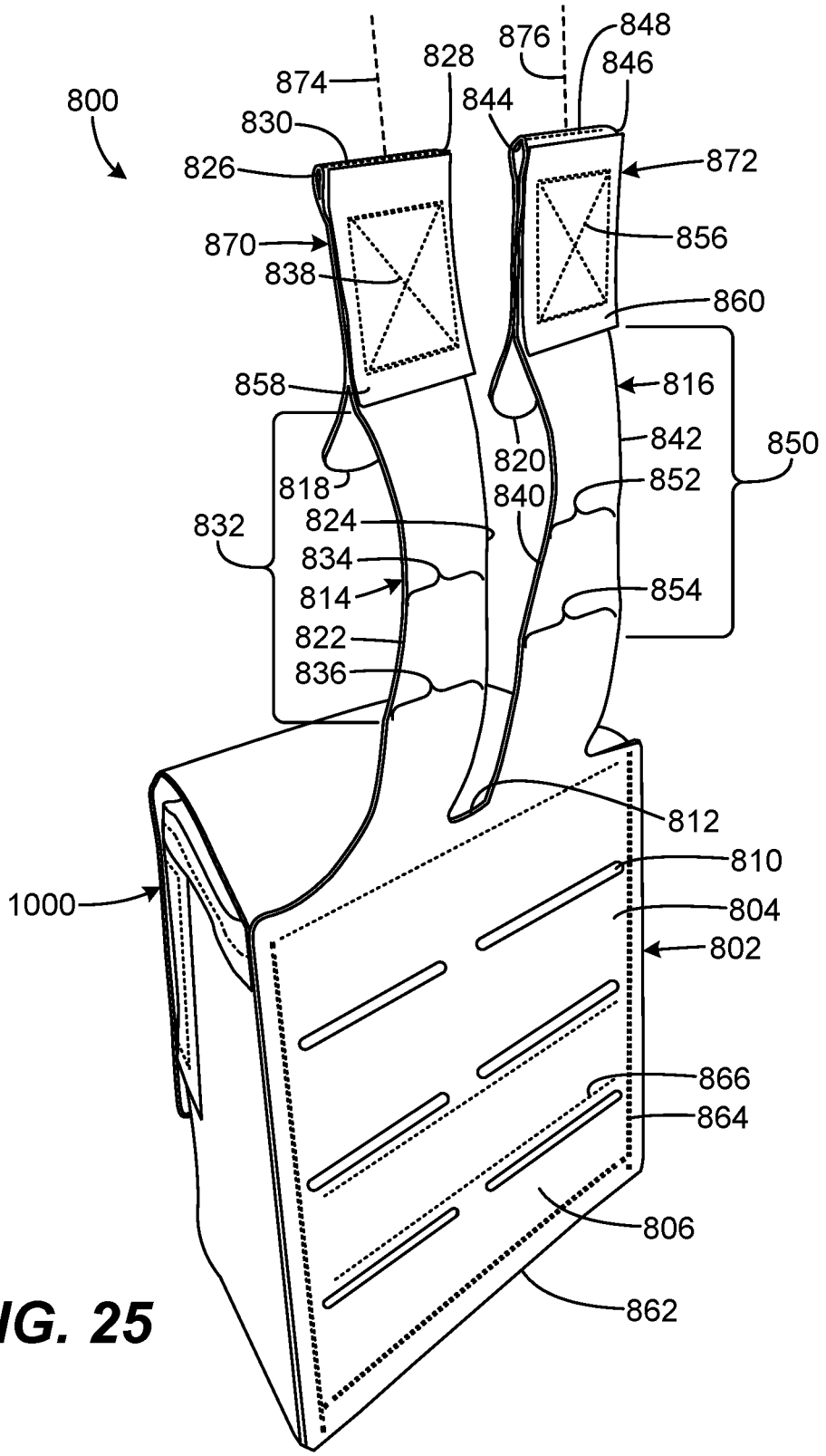
Figure 26:
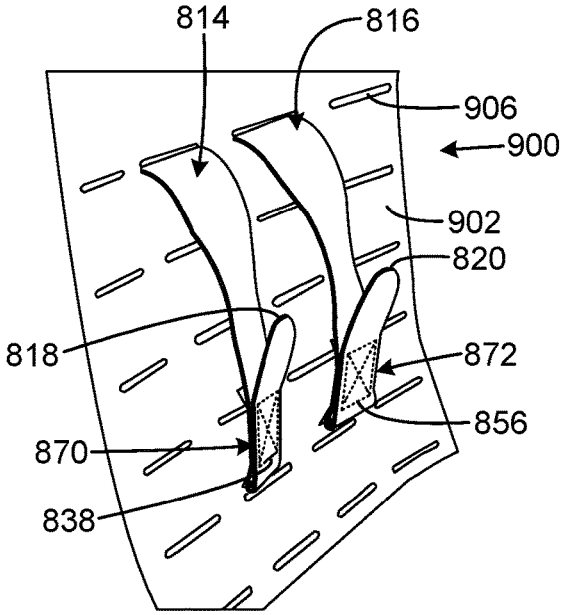
Figure 27:
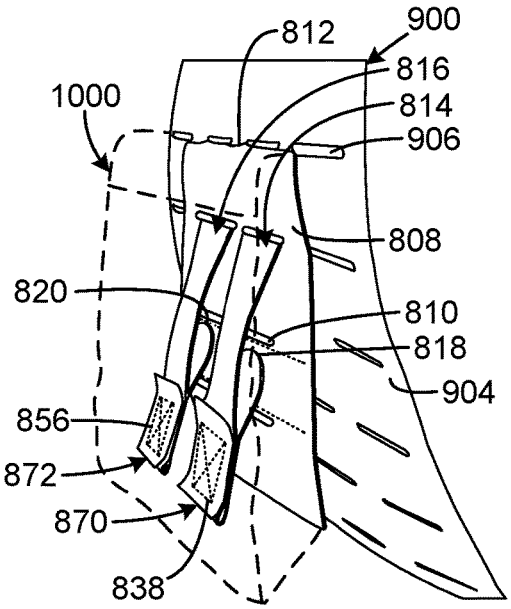
Figure 28:
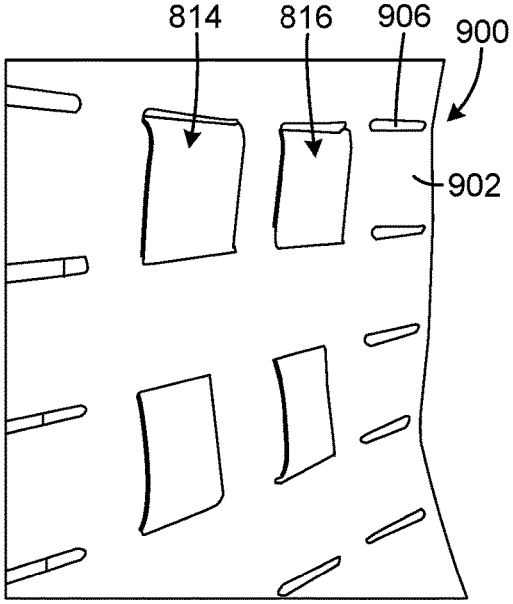
Figure 29:
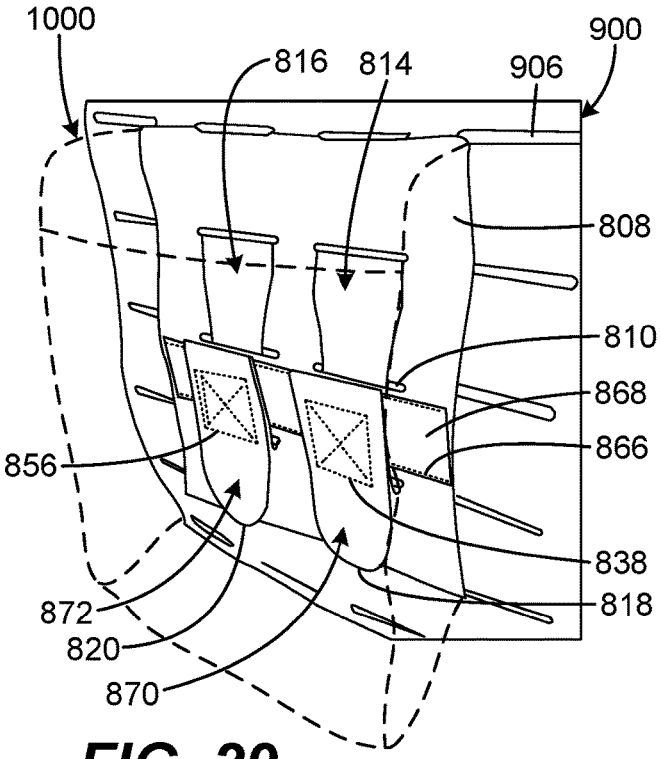

FIG. 25 illustrates a rear isometric view of a second alternative embodiment of the load carrier system of the invention.

FIGS. 26-30 illustrate an example connection configuration of the second alternative embodiment of the load carrier system of the invention.

Figure 31:
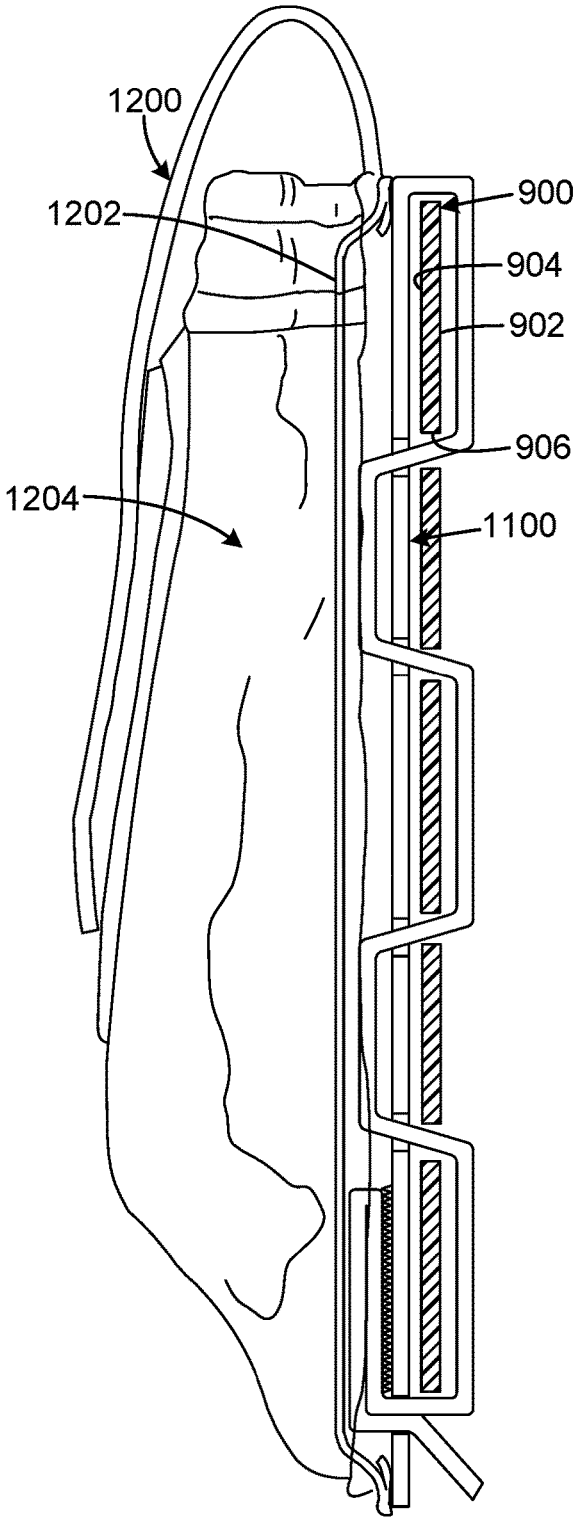

FIG. 31 illustrates a side sectional view of a connection configuration of a third alternative embodiment of the load carrier system of the invention.

DETAILED DESCRIPTION OF EMBODIMENTS OF THE INVENTION

Embodiments of the invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention. Like numbers refer to like elements throughout.

Certain embodiments of the invention generally provide for load carrier systems and associated manufacturing methods. One technical effect or solution of certain embodiments of a load carrier system can provide a relatively easy or quick fastening and detaching mechanism. Another technical effect or solution of certain embodiments of a load carrier system can be reduced manufacturing time and costs, and increased product or manufacturing quality. Yet another technical effect or solution of certain embodiments of a load carrier system is a reduction in weight over conventional load carriers.

FIG. 2 illustrates a front view of an example load carrier system, and FIG. 3 illustrates a back view of the example load carrier system, in accordance with an embodiment of the invention. The load carrier system 200 shown in FIGS. 2 and 3 includes a unitary piece of material 202 and a connected pouch component 203 or compartment. As shown in the back view of FIG. 3, the unitary piece of material 202 can be a preformed or precut shape. The unitary piece of material 202 can include a body portion 204 and one or more straps 206, such as three (3) straps, including respective extended ends 208, wherein the straps 206 are an integral part of the body portion 204. In other embodiments, fewer or greater numbers of straps can be used. In this embodiment, the straps 206 can be folded over adjacent to a first peripheral edge 210 of the unitary piece of material 202 and onto a first face side 212 of the material 202. The positions of the straps 206 can be secured to the unitary piece of material by stitching the respective extended ends 208 of the straps 206 to an opposing second peripheral edge 214 of the material 202.

In one aspect of an embodiment, a unitary piece of material can be made from a durable material including, but not limited to, neoprene, high abrasion neoprene, chloroprene, high abrasion chloroprene, canvas, and a camouflaged material.

In the embodiment shown, the unitary piece of material 202 can also include at least one connector strap 216, which, shown in FIGS. 2 and 3, can be two (2) connector straps oriented substantially perpendicular to the one or more straps 206. Similar to the one or more straps 206, the at least one connector strap 216 can include a respective extended end, such as 218, and is an integral part of the body portion 204. Each of the straps 206 and connector straps 216 can be predefined lengths of the unitary piece of material 202. Generally, for each of the straps 206, the predefined length from the first peripheral edge 210 to each respective extended end 208 can be approximately the width of the body portion 204 of the unitary piece of material 202. The connector straps 216 could be shorter, longer, or the same length as the straps 206. One or more of the connector straps 216 can be folded over immediately adjacent to a respective extended end 218 to provide an overlapping portion 220 with added thickness along a portion of the connector strap 216.

Each connector strap 216 can include a fastener device 222, such as a hook and loop connector (Velcro™), mounted adjacent to the respective extended end 218, such as the overlapping portion 220, of the connector strap 216. Using the associated fastener device 222, a connector strap 216 is operable to connect with a corresponding fastener receiving device associated with one or more straps 206, or another object, such as a garment, field pack, or another load carrier system. After the fastener device 222 is mounted to the connector strap 216, a remaining portion 224 of the connector strap 216 between the fastener device 222 and respective extended end 218 may be unconnected to the end 218. The remaining portion 224, also known as a retaining tab, can facilitate retention of the connector strap 216, when the connector strap 216 is interleaved with one or more straps, such as 206.

In one aspect of an embodiment, other fastening devices or techniques can be used.

In use, the load carrier system 200 can also be mounted to an object using the straps 206 and connector straps 216. For example, at least one connector strap 216 can be mounted around the object, and then threaded between at least one strap 206 and the body portion 204 of the load carrier system 200. When the remaining portion 224 or retaining tab of a connector strap 216 is substantially parallel with the associated connector strap 216, the connector strap 216 and remaining portion 224 or retaining tab can be threaded past the strap 206. Once fully inserted, the remaining portion 224 or retaining tab can prevent removal of the connector strap 216 from between the strap 206 and body portion 204 when the remaining portion 224 or retaining tab is in a non-substantially parallel orientation with the associated connector strap 216. When the remaining portion 224 or retaining tab is re-oriented to be substantially parallel with the associated connector strap 216, the connector strap 216 and remaining portion 224 or retaining tab can be fully removed from between the strap 206 and body portion. In any instance, the load carrier system 200 can be connected to an object using the interface between one or more straps 206 and one or more connector straps 216. Example views of a connection configuration, interface, and associated method are shown and described with respect to FIGS. 14-21 and 23 below.

In other embodiments, the load carrier system 200 can also be mounted to another load carrier system, similar to 200, or other object with corresponding straps, similar to 206, and/or connector straps, similar to 216. For example, the straps and connector straps described above in FIGS. 2 and 3 can be mounted on at least two separate objects, such as two load carrier systems 200, and used for connecting the two objects. When the straps, such as 206, are mounted to a first device or system, such as a load carrier system 200 or other device, and the connector straps, such as 216, are mounted to a second device or system, such as another load carrier system similar to 200 or other device, the connector straps 216 of the second device or system can be interleaved between one or more of the straps of the first device or system to connect the first device or system to the second device or system.

Thus, at least one connector strap, similar to 218, mounted to a first load carrier system can be threaded between a strap 206 and the body portion 204 of the load carrier system 200. Likewise, at least one connector strap 216 of the load carrier system 200 can be threaded between at least one strap, similar to 206, and the body portion, similar to 204, of another load carrier system. When the remaining portion 224 or retaining tab of a connector strap 216 is substantially parallel with the associated connector strap 216, the connector strap 216 and remaining portion 224 or retaining tab can be threaded past the strap 206. The remaining portion 224 or retaining tab can prevent removal of the connector strap 216 from between the strap 206 and body portion 204 when the remaining portion 224 or retaining tab is in a non-substantially parallel orientation with the associated connector strap 216. When the remaining portion 224 or retaining tab is re-oriented to be substantially parallel with the associated connector strap 216, the connector strap 216 and remaining portion 224 or retaining tab can be removed from between the strap 206 and body portion. In any instance, the two separate load carrier systems or other objects can be connected together using the interface between one or more straps, similar to 206, and one or more connector straps, similar to 216.

In the embodiments described above, including shown in FIGS. 2 and 3, can be used as a load carrier system to carry objects, such as ammunition, and can be fastened and detached to a garment or field pack relatively easily and quickly.

FIGS. 4-12 illustrate example elements of a method for making a load carrier system according to an embodiment of the invention. FIG. 4 illustrates an example unitary piece of material 300 for the example load carrier system, such as 200 in FIGS. 2 and 3, being cut from a relatively larger piece of material 302. As shown in FIG. 4, the larger piece of material 302 can be marked to sketch an outline 304 of the unitary piece of material 300.

In one embodiment, a computer program or set of computer-executable instructions stored in memory or a computer-readable medium can execute on a processor or computer system. The computer program or set of computer-executable instructions can be operable to die cut or laser cut a unitary piece of material, such as 300, for a load carrier system, such as 200 in FIGS. 2 and 3, from a relatively larger piece of material, such as 302. In other embodiments, a computer program or set of computer-executable instructions can be operable to die cut or laser cut multiple unitary piece of materials, such as 300, for multiple load carrier systems, such as 200 in FIGS. 2 and 3, from a relatively larger piece of material, such as a relatively large roll of material. Thus, in any instance, a computer program or set of computer-executable instructions can operate in conjunction with a cutting machine to die cut or laser cut a unitary piece of material, such as 300, for a load carrier system, such as 200 in FIGS. 2 and 3, from a bulk amount of material, such as roll or a relatively large sheet.

FIG. 5 illustrates the unitary piece of material of FIG. 4 cut away from the relatively larger piece of material, in accordance with an embodiment of the invention. As shown in FIG. 5, the unitary piece of material 300 can include a body portion, such as 306, one or more straps 308, and one or more connector straps 310. The embodiment shown includes three elongated straps 308 and two elongated connector straps 310. The rectangular-shaped body portion is oriented with the three elongated straps 308 extending from a relatively long, first peripheral edge 312, which is opposite an opposing second peripheral edge 314. The two elongated connector straps 310 extend from a relatively short, third peripheral edge 316, which is opposite a fourth peripheral edge 318. In this example, the body portion 306 is approximately 7 inches by 5 inches in dimension, the three straps 308 are approximately 6 inches in length by 1 inch in width, and the two connector straps 310 are approximately 8.5 inches in length by 1 inch in width. The straps 308 are centered approximately 1.5 inches, 3.5 inches, and 4.5 inches from the third peripheral edge 316, and the two connector straps 310 are centered approximately 1.0 inch and 4.0 inches from the second peripheral edge 314. All of the straps 308 and connector straps 310 are an integral part of the body portion 306.

In other embodiments, different dimensions for a body portion, straps, connector straps, and fewer or greater numbers of straps and connector straps can exist. In yet other embodiments, the straps and connector straps for a particular body portion may differ in shape and dimension.

FIG. 6 illustrates an example marking operation performed on the unitary piece of material of FIGS. 4-5, in accordance with an embodiment of the invention. As shown in FIG. 6, the unitary piece of material 300 can be notched or otherwise marked for additional manufacturing steps. In this example, relatively small notches 318 can be cut from opposing elongated sides of the connector straps 310. These notches 318 can be used to indicate a folding location for the respective ends 320 of the connector straps 310. Furthermore, relatively small markings 322 can be indicated on a central portion of the body portion 306 to assist in positioning the straps 308 when the straps 308 are folded adjacent to the first peripheral edge 312 and onto a first face side 324 of the body portion 306. In this example, the notches 318 are positioned approximately 2 inches from the respective ends 320 of the connector straps 310. Further, the markings are indicated along a centerline 326 of the body portion 306 at approximately 1.0, 2.0, 3.0, and 5.0 inches from the third peripheral edge 316. One skilled in the art will recognize other devices and/or techniques to indicate folding positions for the connector straps 310 and/or to indicate positions of the straps 308 as each is folded onto the first face side 324.

In one embodiment, a computer program or set of computer-executable instructions can be operable to die cut or laser cut the relatively small notches, such as 318, in opposing elongated sides of the connector straps, such as 310. Furthermore, a computer program or set of computer-executable instructions can be operable to generate relatively small markings, such as 322, to indicate on a central portion of the body portion 306 where to position the straps, such as 308, when the straps 308 are folded adjacent to the first peripheral edge 312 and onto a first face side 324 of the body portion 306.

In one embodiment, a computer program or set of computer-executable instructions can be operable to cut or otherwise mark alphanumeric characters on the body portion 306. For example, a laser cutting tool could be used to create alphanumeric text including a part number, a patent pending status, and/or contact information on at least one side of the body portion 306 before, during, or after the marking operation described above. In this manner, the ultimate weight of a load carrier system, such as 200, can be further reduced.

FIG. 7 illustrates an example assembly operation performed on the unitary piece of material of FIGS. 4-6, in accordance with an embodiment of the invention. As shown in FIG. 7, a hook fastener 326 can be mounted to at least one of the straps, such as the lowest positioned strap 308A. In this example, the hook fastener is approximately 5.0 inches in length by 1.0 inches in width, and can be substantially on top of one side of the strap 308A. The hook fastener 326 can be operable to cooperate with a corresponding loop fastener, which collectively, are known as a hook and loop fastener, such as a Velcro™ fastener. Alternatively, a loop fastener or other type of fastener device can be mounted to the strap 308A. In any instance, the hook fastener 326 is sewn or stitched to the strap 308A, and could, in certain instances, be glued or RF welded. One skilled in the art will recognize other devices and/or techniques to mount a fastening device or otherwise mount a fastener to the straps, such as 308A.

In one embodiment, a computer program or set of computer-executable instructions can be operable to mount a hook fastener, such as 326, to at least one of the straps, such as the lowest positioned strap 308A.

FIG. 8 illustrates another example assembly operation performed on the unitary piece of material of FIGS. 4-7, in accordance with an embodiment of the invention. As shown in FIG. 8, each of the straps 308 can be folded over adjacent to the first peripheral edge 312 onto the first face side 324 of the body portion 306. In certain instances, each of the straps 308 can be aligned with one or more markings 322. When suitably aligned with the body portion 306 and markings 322, each respective end 320 of the straps 308 can be fastened to the opposing second peripheral edge 314 with little or no overlap of the straps 308 past the edge 314. Further, when each respective end 320 of the one or more straps 308 is suitably aligned, the ends 320 can be fastened to the second peripheral edge 314 by sewing, stitching, gluing, or RF welding. One skilled in the art will recognize other devices and/or techniques to fasten the straps 308 to the second peripheral edge 314.

In one embodiment, a computer program or set of computer-executable instructions can be operable to fold over each of the straps 308 adjacent to the first peripheral edge 312 onto the first face side 324 of the body portion 306. In certain instances, a computer program or set of computer-executable instructions can be operable to align each of the straps 308 with one or more markings 322. Further, a computer program or set of computer-executable instructions can be operable to fasten each respective end 320 of the straps 308 to the opposing second peripheral edge 314 with little or no overlap of the straps 308 past the edge Moreover, a computer program or set of computer-executable instructions can be operable to fasten the ends 320 to the second peripheral edge 314 by sewing, stitching, gluing, or RF welding.

FIG. 9 illustrates an initial assembly stage for the unitary piece of material of FIGS. 4-8, in accordance with an embodiment of the invention. As shown in FIG. 9, each of the straps 308 is suitably aligned and fastened with respect to the second peripheral edge 314 and first face side 324 of the body portion 306. In certain instances, the straps 308 can be further fastened along the centerline 326 of the body portion 306 to provide additional integrity or attachment strength for the straps 308 associated with the body portion 306. The straps 308 can be fastened along the centerline 326 of the body portion 306 by sewing, stitching, gluing, or RF welding. One skilled in the art will recognize other devices and/or techniques to fasten the straps 308 along the centerline 326 of the body portion 306.

In one embodiment, a computer program or set of computer-executable instructions can be operable to suitably align and fasten each of the straps 308 with respect to the second peripheral edge 314 and first face side 324 of the body portion 306. A computer program or set of computer-executable instructions can be further operable to fasten the straps 308 along the centerline 326 of the body portion 306 to provide additional integrity or attachment strength for the straps 308 associated with the body portion 306. Moreover, a computer program or set of computer-executable instructions can be operable to fasten the ends 320 along the centerline 326 of the body portion 306 by sewing, stitching, gluing, or RF welding.

FIG. 10 illustrates an example folding operation performed on the unitary piece of material of FIGS. 4-9, in accordance with an embodiment of the invention. As shown in FIG. 10, each of the respective ends 320 of the connector straps 310 can be folded over at the respective notches 318. In the example shown, an overlapping portion 328 of each connector strap 310 can be approximately 2.0 inches in length. The folded connector straps 310 can provide added thickness to a portion of the connector strap 310, which can later be used to facilitate securing or otherwise connecting the connector strap 310 to one or more straps 308 of a load carrier system, such as 200, or other object with associated straps, similar to 308.

In one embodiment, a computer program or set of computer-executable instructions can be operable to fold over each of the respective ends 320 of the connector straps 310 at the respective notches 318 to create an overlapping portion 328 along each of the connector straps 310.

FIG. 11 illustrates another example assembly operation performed on the unitary piece of material of FIGS. 4-10, in accordance with an embodiment of the invention. As shown in FIG. 11, a loop fastener 330 can be mounted to a portion of the connector straps 310, such as an end portion 332 of the overlapping portion 328. In this example, the loop fastener is approximately 2.0 inches and length, and can be folded over the end portion 332 of the overlapping portion 328 to provide approximately 1.0 inches of the loop fastener 330 on each of the opposing sides of the connector straps 310. In any instance, the loop fastener 330 can be operable to cooperate with a corresponding hook fastener, such as 326, which collectively, are known as a hook and loop fastener, such as a Velcro™ fastener. Alternatively, a hook fastener or other type of fastener device can be mounted to the strap 308A. In any instance, the hook fastener 326 is sewn or stitched to the end portion 332 of the overlapping portion 328, and could, in certain instances, be glued or RF welded. One skilled in the art will recognize other devices and/or techniques to mount a fastening device or otherwise mount a fastener to the connector straps 310.

In certain embodiments, a remaining portion 334 of the connector straps 310, each also known as a retaining tab, may be left unconnected to the connector straps 310 along the respective ends 320. In the example shown, the remaining portion 334 or retaining tabs can be approximately 1.0 inches in length by 1.0 inches in width. The remaining portion 334 or retaining tab, can facilitate retention of the connector straps 310, when the connector straps 310 are interleaved with one or more straps, such as 308 or 308A.

In one embodiment, a computer program or set of computer-executable instructions can be operable to mount a loop fastener 330 to a portion of the connector straps 310, such as an end portion 332 of the overlapping portion 328. A computer program or set of computer-executable instructions can be further operable to create a remaining portion 334, or retaining tab, adjacent to the respective ends 320 of the connector straps 310.

FIG. 12 illustrates an intermediate assembly stage for the unitary piece of material of FIGS. 4-11, in accordance with an embodiment of the invention. As shown in FIG. 12, the assembled components 336, including the unitary piece of material 300, are ready for final assembly. During final assembly, the assembled components 336 can be mounted to a garment, a field pack, a piece of luggage, a pocket, a pouch, a compartment, or other object. In this embodiment, a military grade, canvas pouch component or compartment can be mounted to an opposing face side 338 of the unitary piece of material 300. The mounting can be facilitated by sewing, stitching, gluing, RF welding, or any other devices and/or techniques to mount an object to a unitary piece of material. An example of the final assembled product is shown in FIGS. 2 and 3 described above.

In one embodiment, a computer program or set of computer-executable instructions can be operable to mount the assembled components 336 to a garment, a field pack, a piece of luggage, a pocket, a pouch, or other object.

FIG. 13 illustrates an example manufacturing method in accordance with an embodiment of the invention. The method 400 described in FIG. 13 can be used to manufacture a load carrier system, such as 200 in FIGS. 2 and 3, or the device shown in FIGS. 4-12, or other load carrier systems and devices in accordance with embodiments of the invention. The method 400 can be implemented by the example manufacturing system 600 shown in FIG. 22.

The example method 400 begins at block 402, in which a unitary piece of material is provided. In the embodiment of FIG. 13, a unitary piece of material can be similar to 202 in FIGS. 2 and 3, or 300 in FIG. 4.

In one aspect of an embodiment, the unitary piece of material can include at least one of the following: neoprene, high abrasion neoprene, chloroprene, high abrasion chloroprene, canvas, or a camouflaged material.

In one aspect of an embodiment, cutting the unitary piece of material in a unitary shape can include either die cutting or laser cutting the unitary piece of material from a larger piece of material.

Block 402 is followed by block 404, in which the unitary piece of material is cut in a unitary shape including a body portion comprising a first face side, an opposing face side, a first peripheral edge and an opposing second peripheral edge. The unitary shape further includes one or more straps with respective extended ends, wherein the straps are an integral part of the body portion. In the embodiment of FIG. 13, the unitary shape can be similar to that shown above in FIG. 5.

Block 404 is followed by block 406, in which the one or more straps is folded over adjacent to the first peripheral edge onto the first face side. In the embodiment of FIG. 13, the straps can be folded over similar to that shown above in FIG. 8.

Block 406 is followed by block 408, in which at least one respective end of the one or more straps is fastened to the opposing second peripheral edge. In the embodiment of FIG. 13, the respective end of the strap can be fastened similar to that shown in FIG. 9.

In one aspect of an embodiment, at least one connector strap oriented substantially perpendicular to the one or more straps, the at least one connector strap comprising a respective extended end, wherein the at least one connector strap is an integral part of the body portion. Further, in the aspect, the method can further include connecting the fastener device to a fastener receiving device associated with an object.

In one aspect of an embodiment, the method can include providing a compartment, and fastening the compartment to the opposing face side.

After block 408, the method 400 ends.

Other method embodiments in accordance with the invention can include fewer or greater numbers of elements and may incorporate some or all of the functionality described with respect to the components shown in FIGS. 2-12.

Thus, using various embodiments of the methods of manufacture described above, a load carrier system can be made with reduced manufacturing time and costs, and increased product or manufacturing quality.

Figure 14:
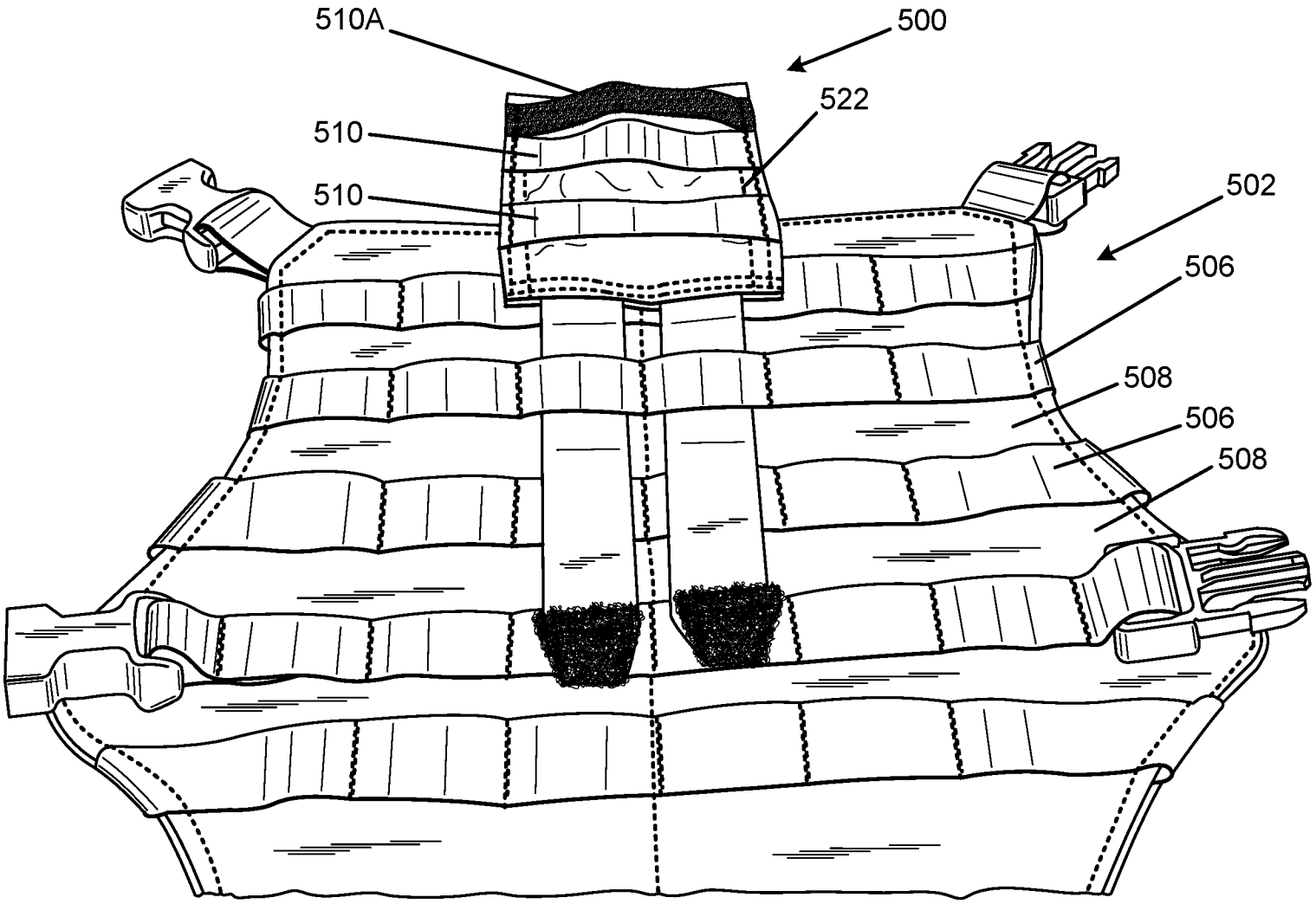
Figure 15:
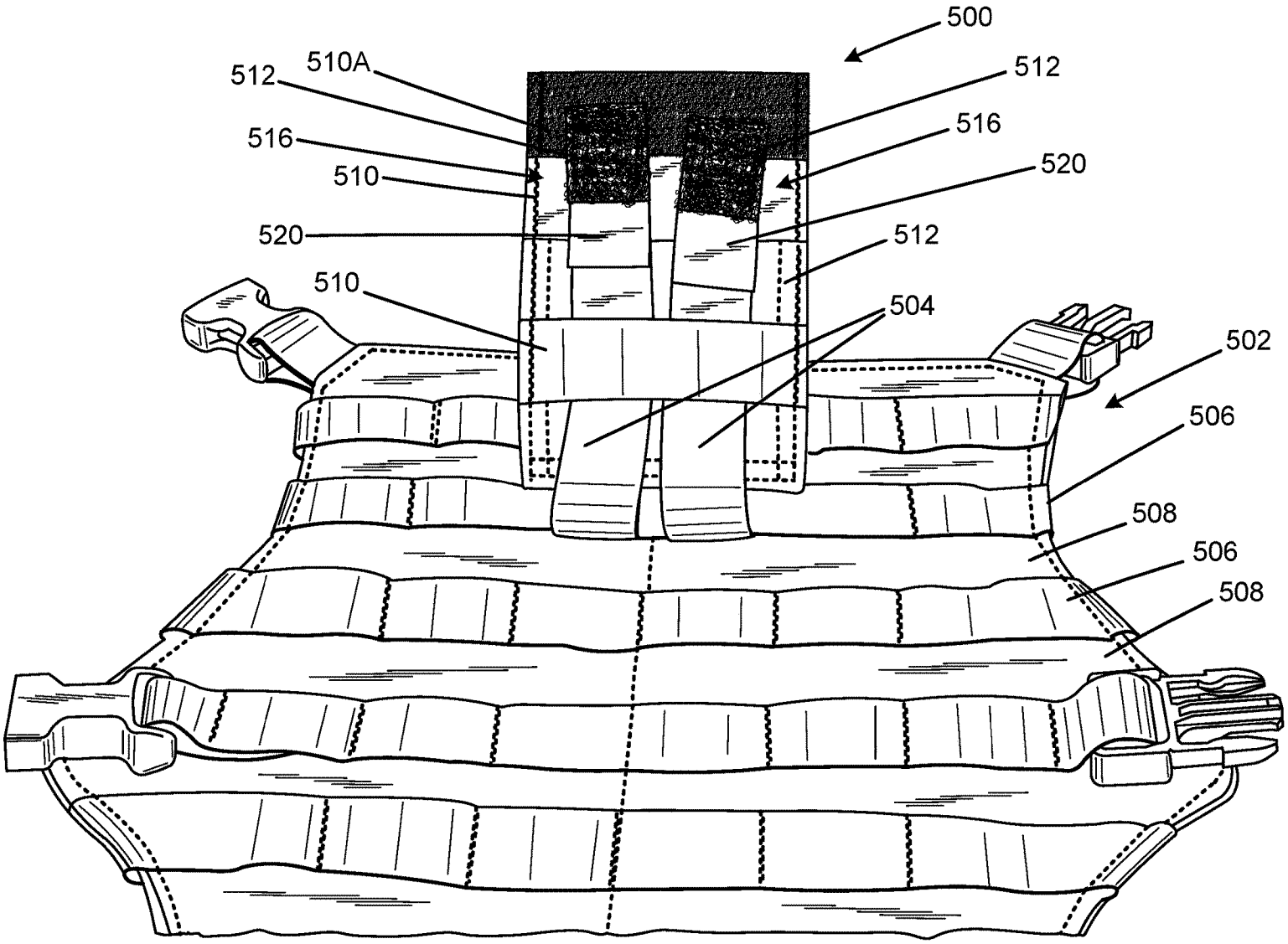
Figure 16:
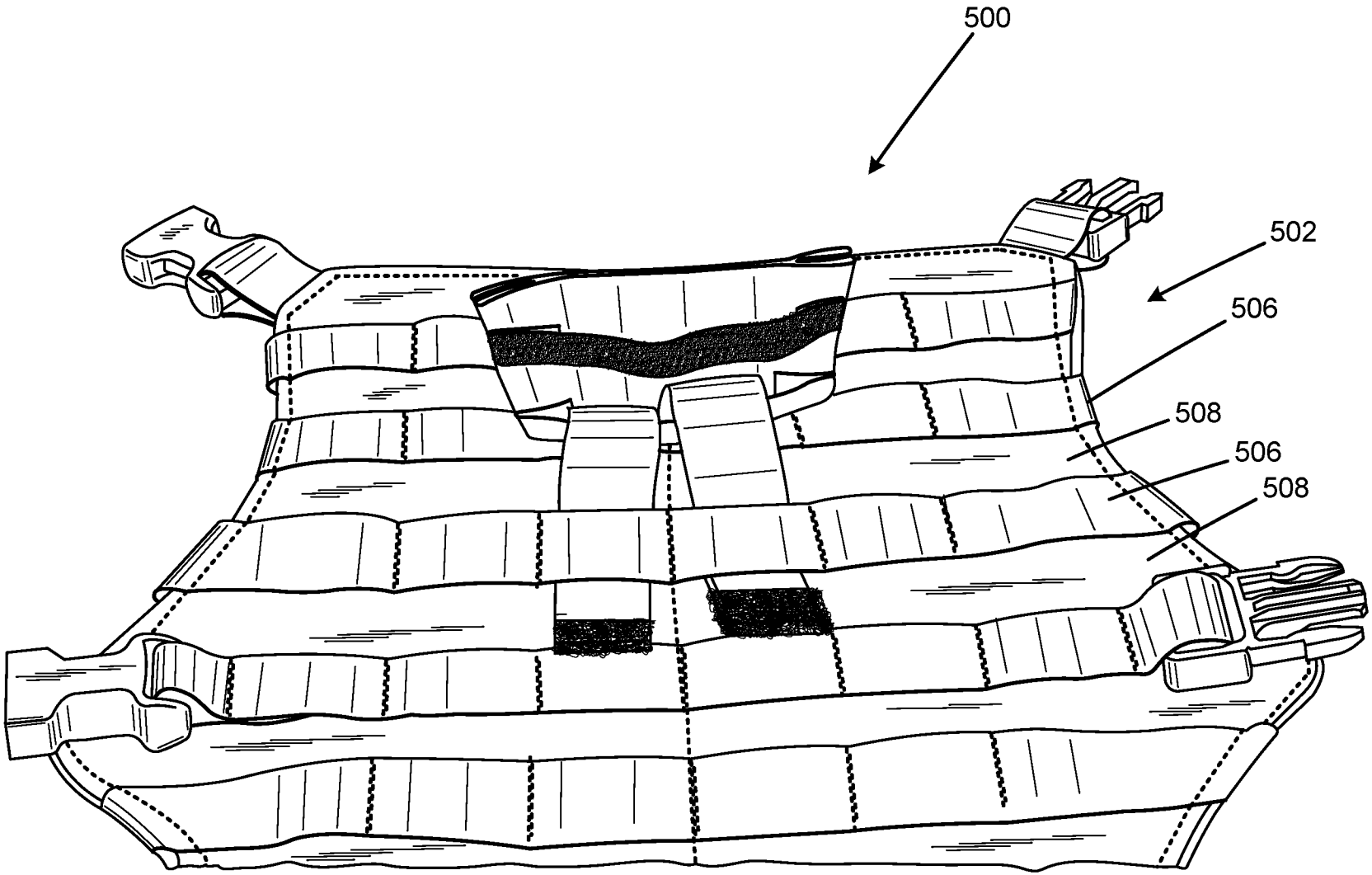
Figure 17:
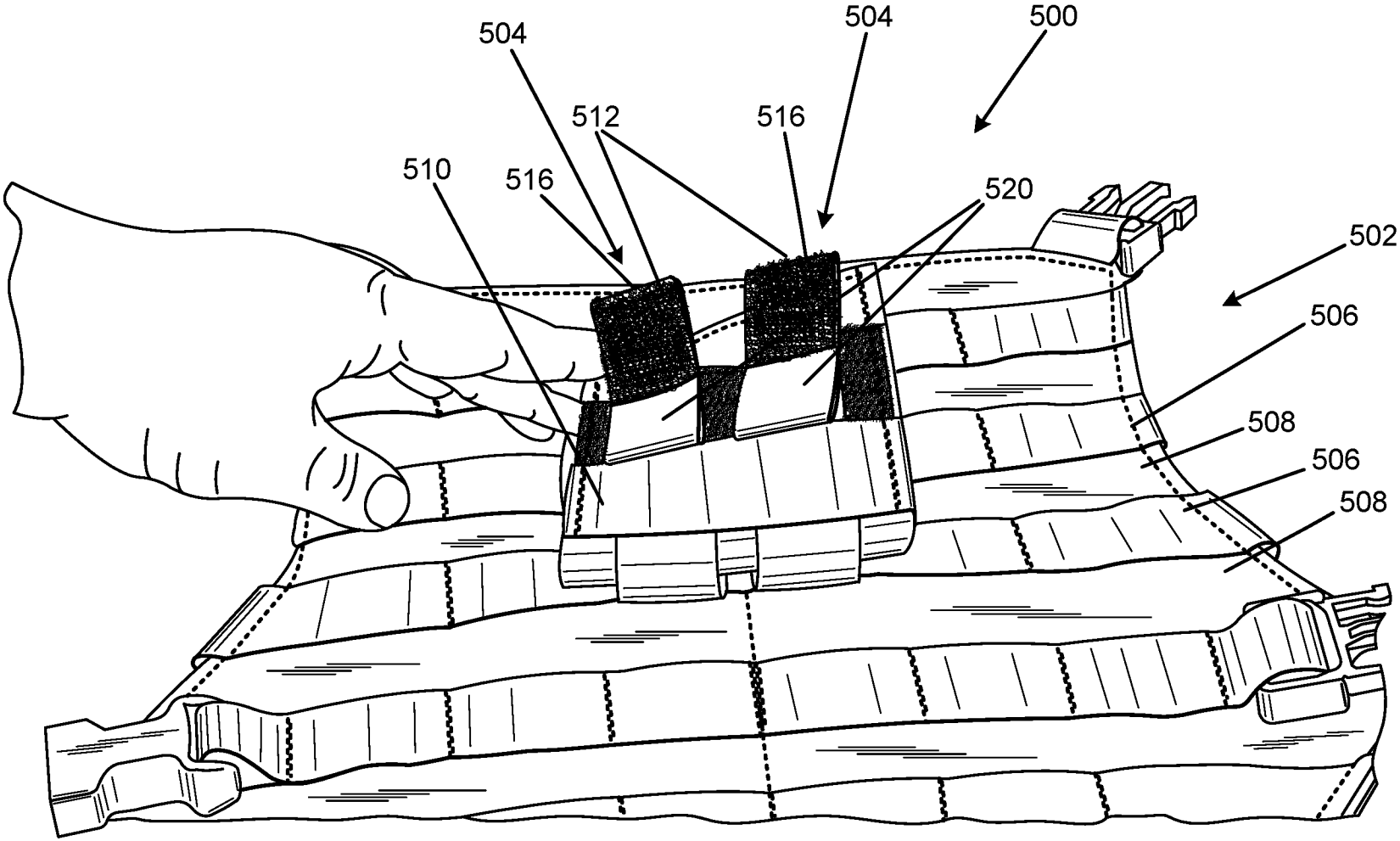
Figure 18:
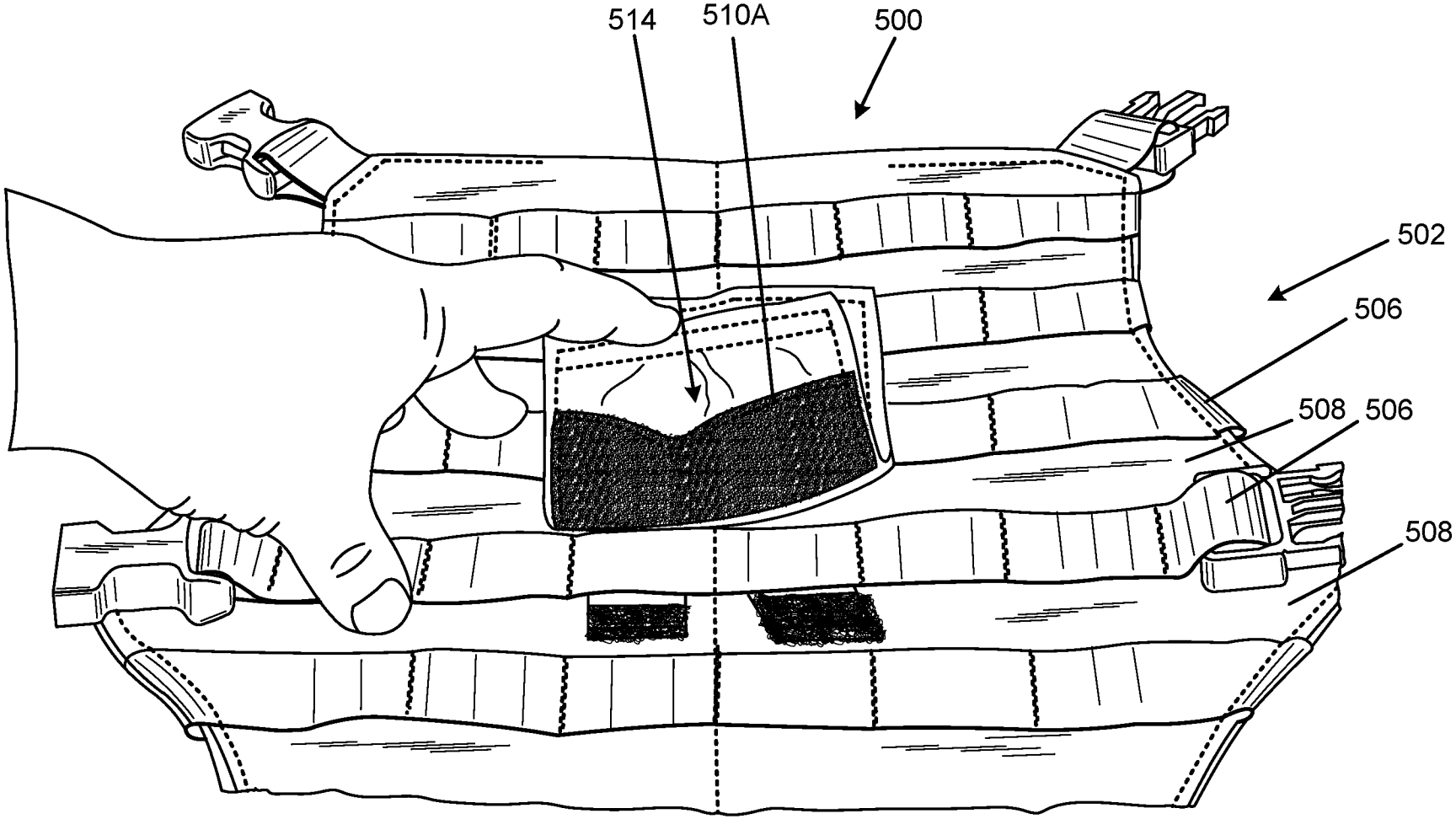
Figure 19:
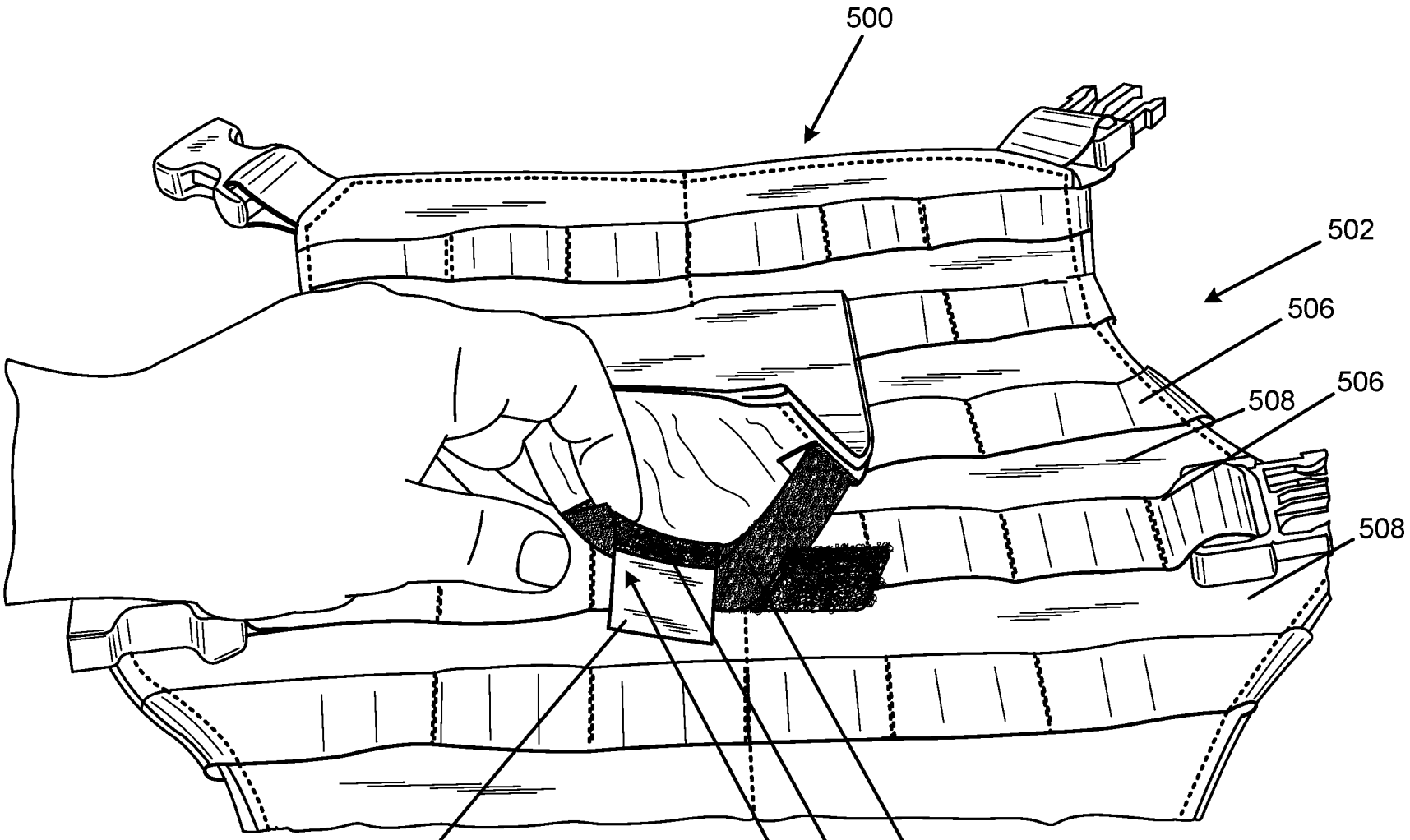
Figure 20:
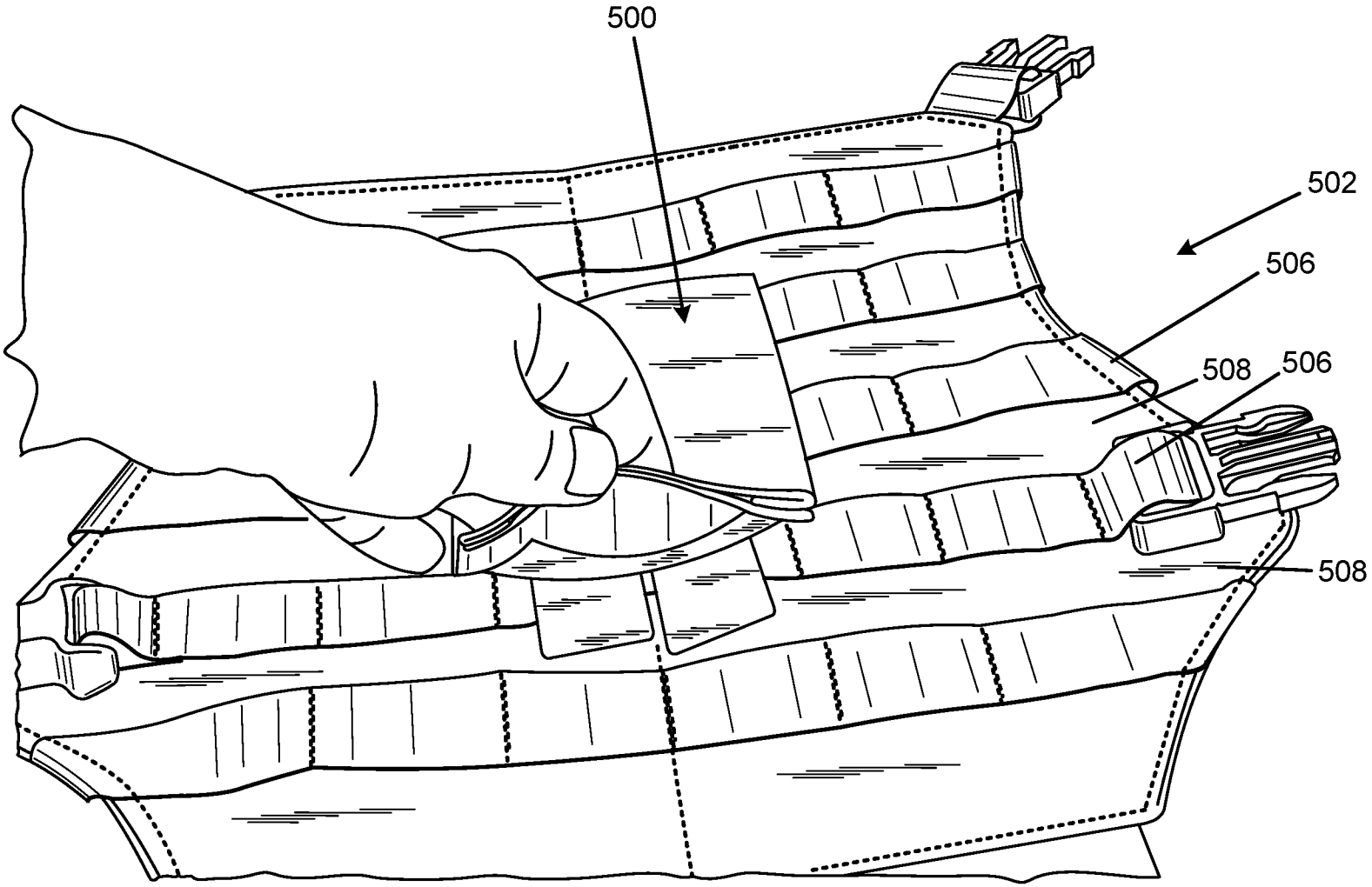
Figure 21:
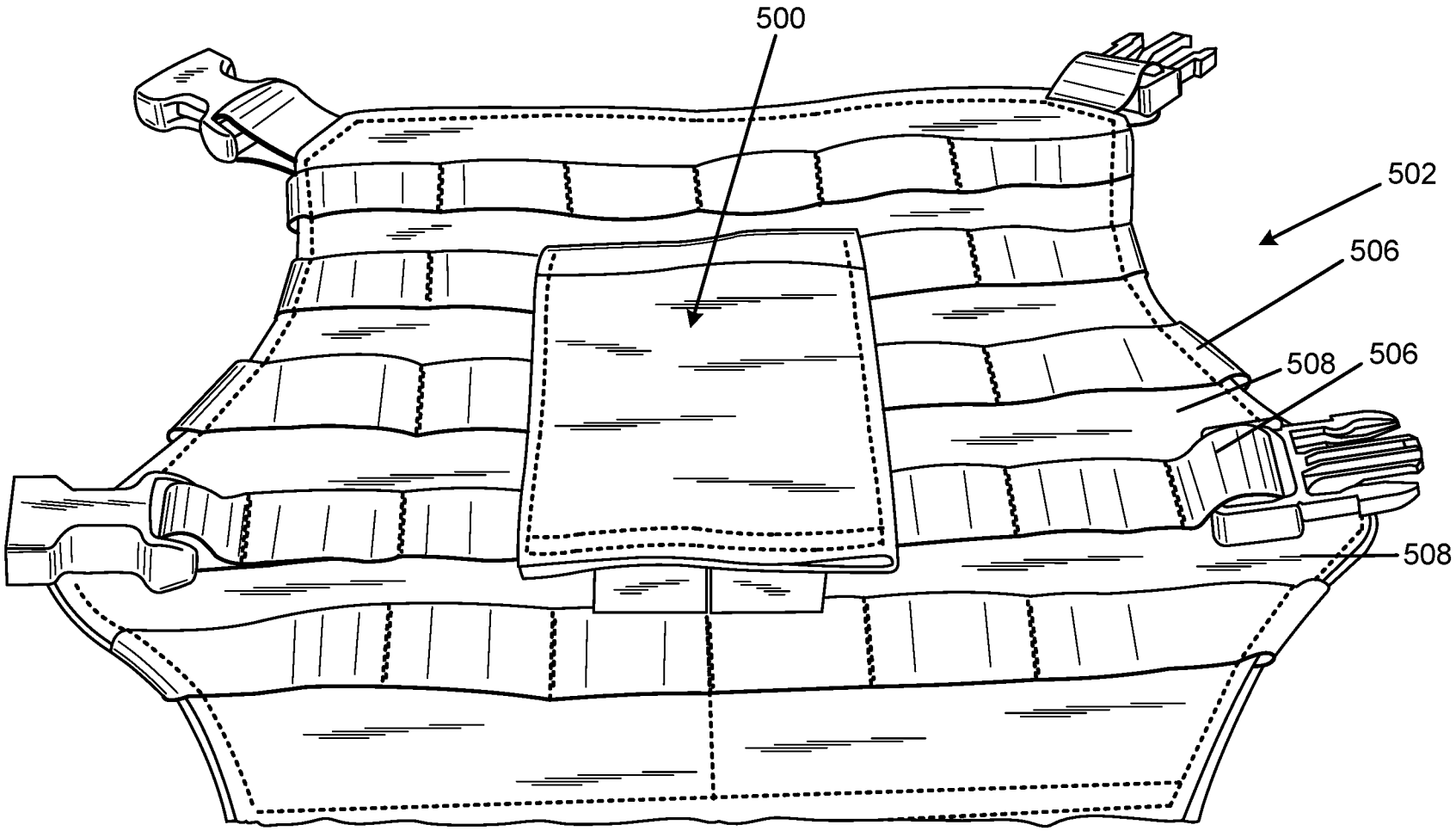

FIGS. 14-21 and 23 illustrate an example connection configuration and method for an example load carrier system in accordance with an embodiment of the invention. The connection configuration and method can be performed by the example manufacturing system 600 shown in FIG. 22. As shown in the series of figures, FIGS. 14-21 and 23, a connection between a load carrier system 500 and an object, such as a wearable component 502, can be created by threading one or more connector straps 504 relatively perpendicular to and between one or more straps 506 and the body portion 508 of the wearable component 502. In certain embodiments, one or more connector straps 504 can be threaded relatively perpendicular to and between one or more straps 510, 510A and the body portion 522 of the load carrier system 500, alternating between the straps 506 of the wearable component 502 and the straps 510, 510A of the load carrier system 500, as seen in FIGS. 14 and 16. In any instance, the one or more connector straps 502 can be retained between the one or more straps 506 and the body portion 508 of the wearable component 502 by a combination of the interaction of associated hook and loop fasteners 512, 514 mounted adjacent to the ends 516 of the connector straps 502 and to one or more straps 510, such as 510A, of the load carrier system 500 as well as the interaction (shown in particular in FIG. 17) of the remaining portion 520, or retaining tab, with the straps 510, 510A of the load carrier system 500 or the straps 506 of the wearable component 502.

Other straps, connecting straps, fastener types, and retaining tab combinations and configurations can exist in accordance with different embodiments of the invention. Two or more wearable components, load carrier systems, and other objects can be connected together using various combinations and configurations of straps, connecting straps, fastener types, and retaining tabs in accordance with other embodiments of the invention.

FIG. 22 illustrates an example manufacturing system 600 in accordance with an embodiment of the invention. The manufacturing system 600 can include a computer 602 with a processor 604, a memory 606, and a set of computer-executable instructions 608 stored in the memory 606. The instructions 608 are operable to execute via the processor 604. In the embodiment shown in FIG. 22, a user can utilize the computer 602 or manufacturing system 600 to manufacture one or more load carrier systems, such as 200 in FIGS. 2 and 3, the device shown in FIGS. 4-12, or other load carrier systems and devices in accordance with embodiments of the invention.

The manufacturing system 600 can also include a cutting tool 610, a stitching tool 612, and a folding tool 614. Each of these tools 610, 612, 614 can be controlled by the computer 602 and/or processor 604 executing the instructions 608 stored in the memory 608. Example instructions are described above with respect to FIGS. 4-12. Each of the cutting tool 610, a stitching tool 612, and a folding tool 614 can operate on a unitary piece of material, such as 616, and/or a relatively larger piece of material 618. Ultimately, the manufacturing system 600 can be used to manufacture one or more load carrier systems, such as 200 in FIGS. 2 and 3, the device shown in FIGS. 4-12, or other load carrier systems and devices in accordance with embodiments of the invention.

The computer 602 may also comprise any number of other external or internal devices such as a mouse, a CD-ROM, DVD, a keyboard, a display, printer, printing device, output display, display screen, a tactile device, a speaker, or other input or output devices. For example, a computer such as 602 may can be in communication with an output device via a communication or input/output interface. Examples of computers are personal computers, mobile computers, handheld portable computers, digital assistants, personal digital assistants, cellular phones, mobile phones, smart phones, pagers, digital tablets, desktop computers, laptop computers, Internet appliances, and other processor-based devices. The computer 602 may operate on any operating system capable of supporting a browser or browser-enabled application including, but not limited to, Microsoft Windows®, Apple OSX™, and Linux. A suitable processor can be one provided by Intel Corporation and/or Motorola Corporation. Such processors comprise, or may be in communication with media, for example computer-readable media, which stores instructions that, when executed by the processor, cause the processor to perform the elements described herein. Embodiments of computer-readable media include, but are not limited to, an electronic, optical, magnetic, or other storage or transmission device capable of providing a processor, such as 604, with computer-readable instructions. Other examples of suitable media include, but are not limited to, a floppy disk, CD-ROM, DVD, magnetic disk, memory chip, ROM, RAM, a configured processor, all optical media, all magnetic tape or other magnetic media, or any other medium from which a computer processor can read instructions. Also, various other forms of computer-readable media may transmit or carry instructions to a computer, including a router, private or public network, or other transmission device or channel, both wired and wireless. The instructions may comprise code from any computer-programming language, including, for example, C, C++, C#, Visual Basic, Java, Python, Perl, and JavaScript.

Further, a cutting tool 610 can be a die cutting tool or a laser cutting tool. A stitching tool 612 can be a tool operable to sew, stitch, glue, and/or RF weld one or more load carrier system components together. Finally, a folding tool 614 can be a tool operable to manipulate a unitary piece of material, such as 616, for instance, folding one or more straps and/or connector straps with respect to the body portion of a particular load carrier system or other component.

One may recognize the applicability of embodiments of the invention to other environments, contexts, and applications. One will appreciate that components of the manufacturing system 600 shown in and described with respect to FIG. 22 are provided by way of example only. Numerous other operating environments, system architectures, and device configurations are possible. Accordingly, embodiments of the invention should not be construed as being limited to any particular operating environment, system architecture, or device configuration.

FIGS. 24-31 illustrate an example connection configuration and method for first, second, and third alternative embodiments of the load carrier system in accordance with an embodiment of the invention. FIG. 24 depicts a first alternative embodiment of the load carrier system 700 that is suitable for use with a large pouch (not shown). The load carrier system 700 is a unitary flexible sheet 702 having a generally rectangular body portion 704 with a back face 706 and an opposing front face (not visible). The body portion defines a plurality of slits 710, which are arranged in two vertical columns that are also horizontally aligned in rows in the current embodiment. An elongated left strap 714 and an elongated right strap 716 extend vertically upward in a first direction away from a top edge 712 at a first side of the body portion. The left strap has a free end 718, and the right strap has a free end 720. The left strap defines a left strap axis 760, and the right strap defines a right strap axis 762. Each column of slits is aligned with an associated one of the left and right straps, and each column of slits is aligned with an associated strap axis. Each of the slits is oriented perpendicularly to the associated strap axis.

The left strap 714 has a left side 722 and right side 724. The left side defines a left indentation 726, and the right side defines a right indentation 728. The left and right indentations mark a fold line 730 that extends between them. The left strap has a variable width portion 732 located between the fold line and the body portion 704. The left and right sides are serpentine within the variable width portion, creating two narrow portions 734, 738 with an intervening wide portion 736. In the current embodiment, the narrow portions are narrower than the width of the slits 710, and the wide portion has the same width as the slits 710 such that the slits are adapted to receive the straps.

The right strap 716 has a left side 740 and a right side 742. The left side defines a left indentation 744, and the right side defines a right indentation 746. The left and right indentations mark a fold line 748 that extends between them. The right strap has a variable width portion 750 located between the fold line and the body portion 704. The left and right sides are serpentine within the variable width portion, creating two narrow portions 752, 756 with an intervening wide portion 754. In the current embodiment, the narrow portions are narrower than the width of the slits 710, and the wide portion has the same width as the slits 710. In FIG. 24, the load carrier system 700 is shown in an unfinished state, which omits folding and stitching of the left and right straps to form left and right tabs, attachment of the hook portion of a hook and loop fastener to the left and right tabs, attachment of the loop portion of a hook and loop fastener to the front face of the body portion 704, and attachment of a pouch to the front face of the body portion.

FIG. 25 depicts a second alternative embodiment of the load carrier system 800 that is suitable for use with a small pouch 1000. The pouch 1000 can be regarded as a plurality of sheets of material connected to each other to define a compartment 1002 (shown in FIG. 30). The load carrier system 800 is depicted in a finished state that is ready for use. The load carrier system 800 is a unitary flexible sheet 802 having a generally rectangular body portion 804 with a back face 806 and an opposing front face 808 (shown in FIGS. 27 & 29). The body portion can be regarded as one of the plurality of sheets that defines the compartment 1002. The body portion defines a plurality of slits 810, which are arranged in two vertical columns that are horizontally aligned in the current embodiment. The left strap defines a left strap axis 874, and the right strap defines a right strap axis 876. Each column of slits is aligned with an associated one of the left and right straps, and each column of slits is aligned with an associated strap axis. Each of the slits is oriented perpendicularly to the associated strap axis.

Because the load carrier system 800 is designed to be used with a small pouch, the sheet 802 and body portion 804 are smaller than sheet 702 and body portion 704, and body portion 804 has fewer rows of slits than does body portion 704. The body portion 804 has stitching 864 that extends around perimeter 862 to attach the pouch 1000 with the body portion 804 serving as the back wall of the pouch. Stitching 866 secures the loop portion 868 (second fastener element) of a hook and loop fastener (shown in FIGS. 27 & 29) to the front face 808 of the body portion 804.

A left strap 814 and a right strap 816 extend vertically upward from a top edge 812 of the body portion 804. The left strap has a free end 818, and the right strap has a free end 820. Left and right straps 814, 816 are shorter than left and right straps 714, 716 to match the correspondingly smaller body portion 804 of the load carrier system 800.

The left strap 814 has a left side 822 and right side 824. The left side defines a left indentation 826, and the right side defines a right indentation 828. The left and right indentations mark a fold line 830 that extends between them. The left strap has a variable width portion 832 located between the fold line and the body portion 804. The left and right sides are serpentine within the variable width portion, creating a narrow portion 834 and a wide portion 836. In the current embodiment, the narrow portion is narrower than the width of the slits 810, and the wide portion has the same width as the slits 810. The left strap has been folded along fold line 830. Stitching 838 both secures the left strap in the folded condition to form a left tab 870 and secures the hook portion 858 of a hook and loop fastener to the left tab.

The right strap 816 has a left side 840 and a right side 842. The left side defines a left indentation 844, and the right side defines a right indentation 846. The left and right indentations mark a fold line 848 that extends between them. The right strap has a variable width portion 850 located between the fold line and the body portion 804. The left and right sides are serpentine within the variable width portion, creating a narrow portion 852 and a wide portion 854. In the current embodiment, the narrow portion is narrower than the width of the slits 810, and the wide portion has the same width as the slits 810. The right strap has been folded along fold line 848. Stitching 856 both secures the right strap in the folded condition to form a right tab 872 and secures the hook portion 860 of a hook and loop fastener (first fastener element) to the right tab.

As shown in the series of figures, FIGS. 26-30, a connection between the second alternative embodiment of the load carrier system 800 and an object, such as a wearable component 900 having a back face 902 and a front face 904, can be created by threading one or both of the left and right straps 814, 816 relatively perpendicular to and through one or more slits 906 in the wearable component 900. In certain embodiments, one or both of the left and right straps can be threaded relatively perpendicular to through one or more slits 810 in the body portion 804 of the load carrier system 800, alternating between the slits of the wearable component 900 and the slits of the load carrier system 800, as seen in FIGS. 26-30. The weaving steps in which the left and right straps are folded at the first edge/top edge 812 and inserted through the slits 906 and 810 form loops adapted to secure the load carrier element/system 800 to a load carrier/wearable component 900. In any instance, one or both of the left and right straps can be retained against the front face of the wearable component by a combination of the interaction/connection of the hook portions 858, 860 of hook and loop fasteners mounted adjacent to the free ends 818, 820 of the left and right straps and the loop portion 868 of hook and loop fasteners on the front face 808 of the load carrier system 800 as well as the interaction of the left and right tabs 870, 872 with the slits 810 of the load carrier system 800 or the slits 906 of the wearable component 900. Furthermore, the variable width portions 832, 850 of the left and right straps prevent inadvertent withdrawal of the left and right straps from the slits 810 of the load carrier system 800 and the slits 906 of the wearable component 900. The load carrier system 700 functions to attach a larger pouch (not shown) than pouch 1000 in an identical manner to the wearable component 900 as does the load carrier system 800. The primary difference is the load carrier system 700 may require additional weaving steps compared to the load carrier system 800 to account for the longer left and right straps 714, 716 and the additional slits 710 on the body portion 704. The additional weaving steps can enable the larger pouch of the load carrier system 700 to carry more weight when attached to the wearable component 900 than the pouch 1000 of the load carrier system 800.

Figure 30:
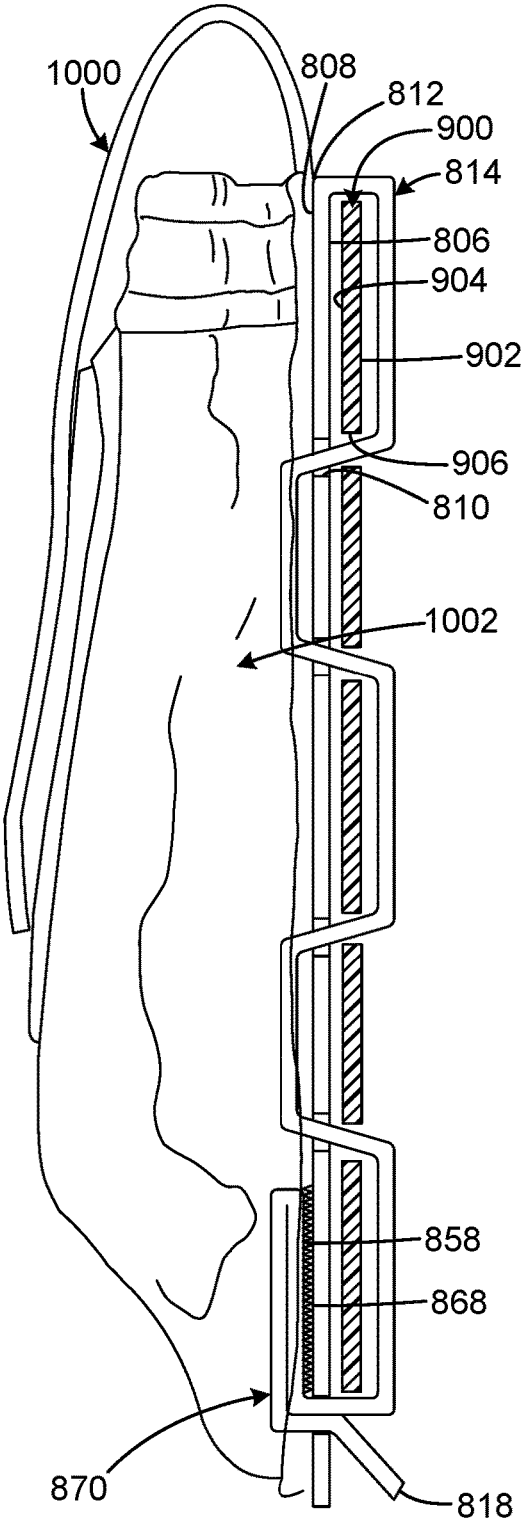

It should be appreciated that the load carrier systems 700 and 800 result in a pouch having a plurality of slits in the back wall of the pouch because the body portion forms a panel of the pouch defining a compartment (pouch 1000 has a compartment 1002 shown in FIG. 30). While the presence of slits does not present any difficulties with respect to the storage of many articles within the compartment of a pouch, the user may encounter circumstances where the presence of slits in the back wall of the pouch is incompatible with the item(s) to be carried. FIG. 31 depicts a third alternative embodiment of the load carrier system 1100. The primary difference between the load carrier system 1100 and the load carrier system 800 is the pouch 1200 attached to load carrier system 1100 has a separate back wall 1202 that omits any slits in communication with compartment 1204 with the body portion overlaying the back wall/panel of the pouch. Thus, the pouch 1200 and load carrier system 1100 can be used to attach items to the wearable component 900 where the presence of slits in the back wall of the pouch would be problematic. Otherwise, the load carrier system 1100 is identical to the load carrier system 800 in both form and function.

It will be appreciated that while the disclosure may in certain instances describe a single example embodiment of a load carrier system, there may be other configurations, shapes, and orientations of a load carrier system and associated load carrier system components without departing from example embodiments of the invention.

One will recognize the applicability of embodiments of the invention to various objects, firearms, weapons, and combinations thereof known in the art. One skilled in the art may recognize the applicability of embodiments of the invention to other environments, contexts, and applications. One will appreciate that components and elements shown in and described with respect to FIGS. 2-29 are provided by way of example only. Numerous other operating environments, system architectures, and various apparatus configurations thereof are possible. Accordingly, embodiments of the invention should not be construed as being limited to any particular operating environment, system architecture, or apparatus configuration.

Additionally, it is to be recognized that, while the invention has been described above in terms of one or more embodiments, it is not limited thereto. Various features and aspects of the above described invention may be used individually or jointly. Although the invention has been described in the context of its implementation in a particular environment and for particular purposes, its usefulness is not limited thereto and the invention can be beneficially utilized in any number of environments and implementations. Furthermore, while the methods have been described as occurring in a specific sequence, it is appreciated that the order of performing the methods is not limited to that illustrated and described herein, and that not every element described and illustrated need be performed. Accordingly, the claims set forth below should be construed in view of the full breadth of the embodiments as disclosed herein.

The invention claimed is:

1. A load carrier element comprising:

a sheet of flexible material;

the sheet having opposed first and second faces;

the sheet having a first edge at a first side of the sheet including a first plurality of elongated straps, at least one of which extends in a first direction; and the sheet having a second edge at a second side of the sheet adjacent to the first side of the sheet and angularly offset from the first side of the sheet, and including a second plurality of elongated straps, at least one of which extends in a second direction angularly offset from perpendicular to the first direction.

2. The load carrier element of claim 1 wherein the sheet is rectangular.

3. The load carrier element of claim 1 wherein the sheet has a width defined by the distance between the first and second edges, and wherein first plurality of elongated straps each have a length at least as great as the width, such that first plurality of elongated straps fully overlay the width of the sheet when folded across the sheet.

4. The load carrier element of claim 1 wherein at least some of first plurality of elongated straps have a width and are spaced apart by a gap at least as great as the width.

5. The load carrier element of claim 1 wherein the first plurality of elongated straps are folded at the first edge of the sheet, and positioned overlaying the sheet with a first face of the first plurality of elongated straps contacting the sheet.

6. The load carrier element of claim 5 wherein first plurality of elongated straps have free ends that are attached to the sheet adjacent to the second edge.

7. The load carrier element of claim 6 wherein each of first plurality of elongated straps is attached to the sheet at at least one tack point intermediate the first and second edges, such that passages are defined between each of the first and second edges, and a respective tack point.

8. The load carrier element of claim 7 wherein each of the passages has a common width.

9. The load carrier element of claim 7 wherein each of the passages is registered with one of the second plurality of elongated straps, such that each of the second plurality of elongated straps may be folded at a third edge of the sheet and threaded through at least one of the passages.

10. The load carrier element of claim 7 wherein each of the second plurality of elongated straps is folded at a third edge of the sheet and threaded through at least one of the passages.

11. The load carrier element of claim 10 wherein each of the second plurality of elongated straps has a selected portion received within a passage, and wherein a first face of the selected portion contacts the sheet within the passage, and wherein a second face of the selected portion contacts the first face of one of the first plurality of elongated straps defining the passage.

12. The load carrier element of claim 10 wherein the sheet has a fourth edge opposite the third edge, and each of the second plurality of elongated straps has a length greater that the distance between the third and fourth edges.

13. The load carrier element of claim 1 including a compartment component defining a compartment attached to a second side of the sheet.

14. The load carrier element of claim 1 wherein the first plurality of elongated straps each have a free end detached from the sheet.

* * * * *